US008702436B2

(12) United States Patent
Lee

(10) Patent No.: US 8,702,436 B2
(45) Date of Patent: Apr. 22, 2014

(54) UNIVERSAL PLUG ADAPTOR

(75) Inventor: Chiu-San Lee, New Taipei (TW)

(73) Assignee: XYZ Science Co., Ltd., New Taipei (TW)

( * ) Notice: Subject to any disclaimer, the term of this patent is extended or adjusted under 35 U.S.C. 154(b) by 180 days.

(21) Appl. No.: 13/351,229

(22) Filed: Jan. 17, 2012

(65) Prior Publication Data

US 2013/0183843 A1 Jul. 18, 2013

(51) Int. Cl.
*H01R 27/00* (2006.01)

(52) U.S. Cl.
USPC ..... 439/222; 439/651; 439/172

(58) Field of Classification Search
USPC ..... 439/218, 222; 174/66, 536
See application file for complete search history.

(56) References Cited

U.S. PATENT DOCUMENTS

| | | | | |
|---|---|---|---|---|
| 4,717,348 | A * | 1/1988 | Mazzullo et al. | 439/76.1 |
| 5,836,777 | A * | 11/1998 | Chen | 439/222 |
| 5,885,109 | A * | 3/1999 | Lee et al. | 439/652 |
| 5,919,060 | A * | 7/1999 | Lee | 439/518 |
| 5,938,459 | A * | 8/1999 | Lee et al. | 439/172 |
| 6,010,347 | A * | 1/2000 | Lee | 439/222 |
| 6,247,941 | B1 * | 6/2001 | Lee et al. | 439/105 |
| 6,281,438 | B1 * | 8/2001 | Desilets et al. | 174/53 |
| 6,328,581 | B1 * | 12/2001 | Lee et al. | 439/106 |
| 6,419,505 | B1 * | 7/2002 | Waible | 439/106 |
| 7,094,085 | B2 * | 8/2006 | Bona et al. | 439/172 |
| 7,234,954 | B1 * | 6/2007 | Srage et al. | 439/222 |
| 7,354,286 | B1 * | 4/2008 | Lee | 439/172 |
| 7,527,508 | B1 * | 5/2009 | Lee et al. | 439/137 |
| 7,857,640 | B1 * | 12/2010 | Lee et al. | 439/137 |
| 8,142,208 | B2 * | 3/2012 | Ruffner | 439/105 |
| 8,313,350 | B2 * | 11/2012 | Lee | 439/651 |
| 2004/0253854 | A1 * | 12/2004 | Lee et al. | 439/106 |
| 2012/0100733 | A1 * | 4/2012 | Lee et al. | 439/172 |
| 2012/0171902 | A1 * | 7/2012 | Lee | 439/660 |

* cited by examiner

*Primary Examiner* — Amy Cohen Johnson
*Assistant Examiner* — Vladimir Imas
(74) *Attorney, Agent, or Firm* — Leong C. Lei

(57) ABSTRACT

The universal plug adaptor contains a terminal set for contacting plug pins housed between a face plate and a casing. The face plate contains a number of sets of plug holes. A first hole set contains a first live hole, a first neutral hole, and a first ground hole conforming to the South Africa specification. A second hole set contains three separate openings, each containing a number of plug holes for ground pins of various specifications. A third hole set contains two plug holes conforming to global 250V specification with two flat pins or two round pins. A fourth hole set contains two plug holes conforming to America 125V specification's two flat pints or two round pins. And a fifth hole set contains two plug holes conforming to America specification with two flat pins. The third and fourth hole sets jointly provide two plugs' simultaneous plugging.

9 Claims, 47 Drawing Sheets

UNIVERSAL PLUG ADAPTOR

TECHNICAL FIELD OF THE INVENTION

The present invention is generally related to universal plug adaptors, and more particular to a universal plug adaptor allowing simultaneous plugging of two plugs.

DESCRIPTION OF THE PRIOR ART

There are various types of electrical plugs and sockets that are different by country in rating, shape, and size.

Due to the rapid electronic technology, most products are designed with energy saving in mind. The conventional wall sockets do not fit this requirement. Additionally, the loose coupling between the plug and socket often causes disconnection or short circuit. When an extension cord is applied, the longer the cord, the more voltage drops and the temperature rises. There is indeed some safety problem to be considered.

Furthermore, the compatibility and robustness of the coupling between the plug pin and the socket terminal has to be designed with the required safety standard. The material cost is also a major concern considering the continuously rising cost. For example, for the standard socket of China and Australia, they need to receive three kinds of plugs and the socket face plate therefore requires a sizable area, thereby a higher cost. Each socket usually can only receive one type of plug and this limitation restricts the flexibility significantly. In the nearby areas, Hong Kong uses British plugs, similar to Singapore and Malaysia. In contrast, Taiwan uses America plugs. A flexible socket of plug adaptor has to take all these into consideration.

Again, for Taiwan's plug, due to its smaller form factor, its usability and safety have to be reconsidered, in addition to energy saving, product quality, and environment friendliness.

SUMMARY OF THE INVENTION

To obviate the foregoing shortcomings, a universal plug adaptor is provided herein. The major objectives of the present invention are as follows.

Firstly, for industries producing products for worldwide market, the present invention provides the industries a convenient tool for testing compatibility with specifications of various countries.

Secondly, with the present invention, the wall sockets can be more versatile, support more plugs, provide more safety control for reduced possibility of hazard.

Thirdly, the present invention conforms to the China's standard plug and supports two plugs' simultaneous plugging, making the present invention more convenient and economical.

Fourthly, the present invention supports both America and Taiwan plugs and supports two plugs' simultaneous plugging with more safety control.

Fifth, the present invention is universally applicable to the plugs of various countries. The present invention can be further stacked with additional face plates to achieve even greater applicability.

To achieve the above objectives, the universal plug adaptor contains a face plate having a number of plug holes, and a casing joined to the face plate with a terminal set inside for contacting plug pins. Between the face plate and the casing, a safety-door device conforming to the South Africa specification is configured. The face plate contains a number of sets of plug holes aligned and distributed symmetrically along a middle line of the face plate. A first hole set contains a first live hole, a first neutral hole, and a first ground hole conforming to the South Africa specification. A second hole set contains three separate openings. The first opening contains a second ground hole conforming to the Britain specification, a third ground hole adjacent to the second ground hole conforming to the India specification, a fourth ground hole adjacent to the third ground hole conforming to the China and Australia 10 A and 16 A specifications, a fifth ground hole adjacent to the fourth ground hole conforming to the Denmark specifications, a sixth ground hole adjacent to the fifth ground hole conforming to the Philippine 10 A specification of America 250V, a seventh ground hole coinciding with the sixth ground hole conforming to the America 15 A specification, an eighth ground hole coinciding with the sixth and seventh ground holes conforming to the America 20 A specification, a ninth ground hole adjacent to the sixth, seventh, and eighth ground holes and conforming to the Middle East specification, and a tenth ground hole adjacent to the ninth ground hole and conforming to the Israel specification. The second opening contains an eleventh ground hole conforming to the Brazil specification and a twelfth ground hole adjacent to the eleventh ground hole and conforming to the Italy specification. The third opening contains a thirteenth ground hole conforming to Swiss specification, and the fourteenth ground hole and the fifteenth ground hole, together with a fifth hole set, conforming to two types of America 125V specifications. A third hole set contains two symmetric plug holes conforming to global 250V specification with two flat pins or two round pins. A fourth hole set contains two symmetric plug holes conforming to America 125V specification with two flat pints or two round pins. And the fifth hole set contains two plug holes conforming to the America 125V specification with two flat pins. Especially, the third and fourth hole sets, together with the second hole set, jointly provide two plugs' simultaneous plugging.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
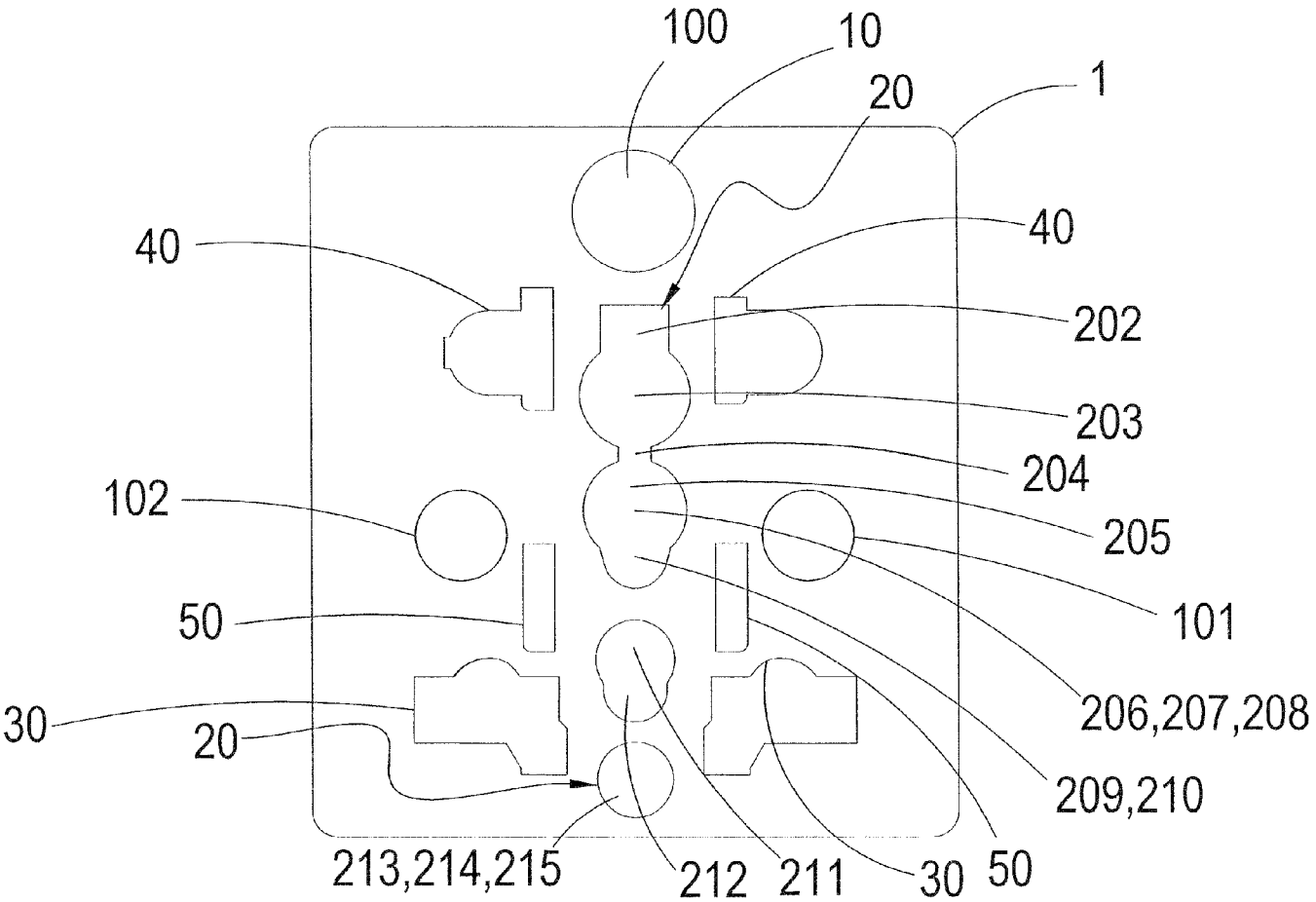
FIG. 1 is a schematic diagram showing a preferred embodiment of the face plate of the present invention.
Figure 2:
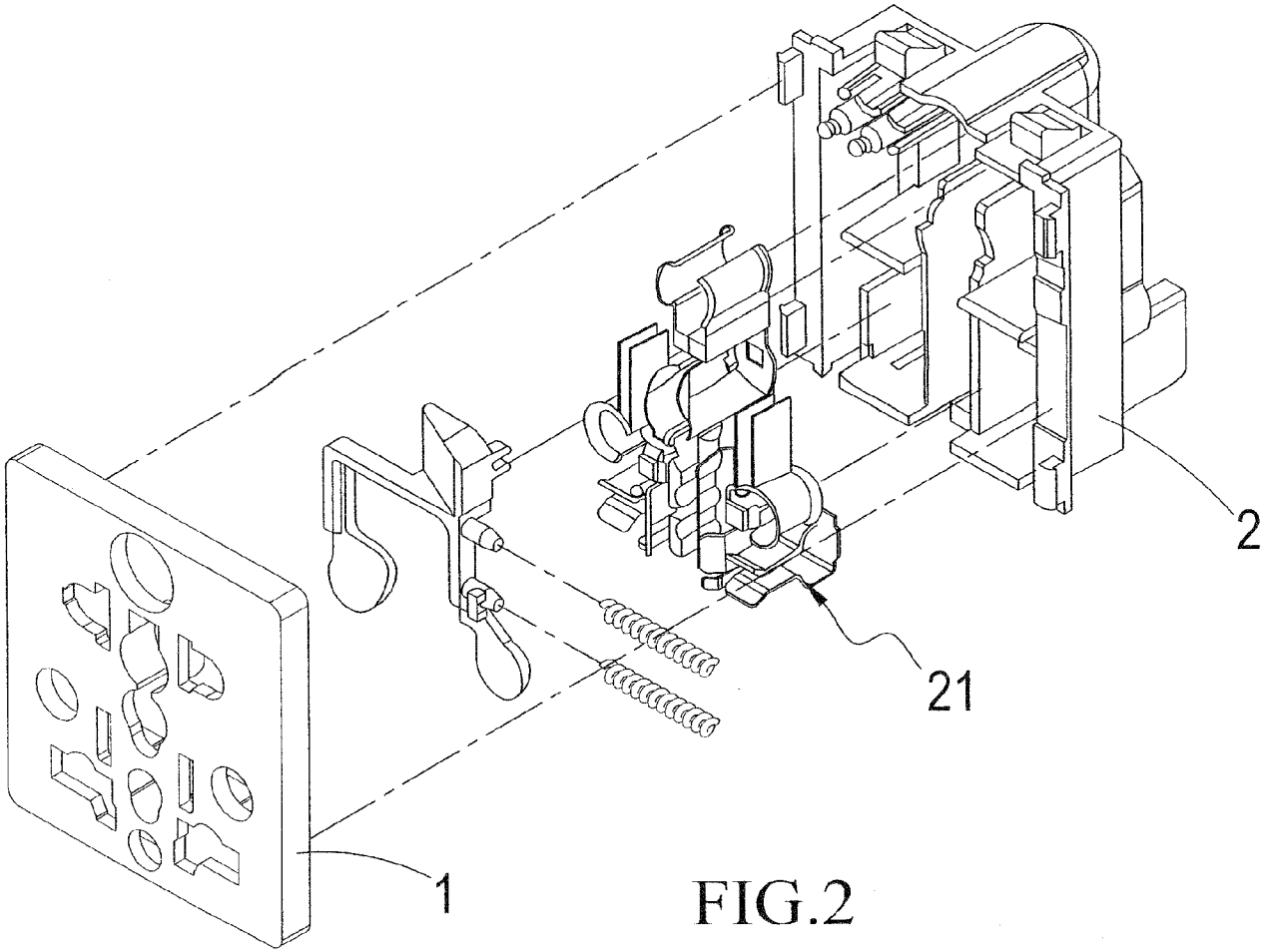
FIG. 2 is a perspective diagram showing the various components of a universal plug adaptor according to the present invention.

As shown in FIGS. 1 and 2, a universal plug adaptor according to the present invention contains a face plate 1 having a number of plug holes, and a casing 2 joined to the face plate 1 with a terminal set 21 inside for contacting plug pins. Between the face plate 1 and the casing 2, a safety-door device conforming to the South Africa specification is configured. The face plate 1 contains a number of sets of plug holes aligned and distributed symmetrically along a middle line of the face plate 1. A first hole set 10 contains a first live hole 101 (for live pin), a first neutral hole 102 (for neutral pin), and a first ground hole 100 conforming to the South Africa specification. A second hole set 20 contains three separate openings sequentially arranged along the middle line, each being a combination of ground holes connected sequentially together: The first opening contains a second ground hole 202 conforming to the Britain specification, a third ground hole 203 adjacent to the second ground hole 202 conforming to the India specification, a fourth ground hole 204 adjacent to the third ground hole 203 conforming to the China and Australia 10 A and 16 A specifications, a fifth ground hole 205 adjacent to the fourth ground hole 204 conforming to the Denmark specifications, a sixth ground hole 206 adjacent to the fifth ground hole 205 conforming to the Philippine 10 A specification of America 250V, a seventh ground hole 207 coinciding with the sixth ground hole 206 conforming to the America 15 A specification, an eighth ground hole coinciding with the sixth and seventh ground holes 207 and 208 conforming to the America 20 A specification, a ninth ground hole 209 adjacent to the sixth, seventh, and eighth ground holes 206, 207, and 208 and conforming to the Middle East specification, and a tenth ground hole 210 adjacent to the ninth ground hole 209 and conforming to the Israel specification. The second opening contains an eleventh ground hole 211 conforming to the Brazil specification and a twelfth ground hole 212 adjacent to the eleventh ground hole 211 and conforming to the Italy specification. The third opening contains a thirteenth ground hole 213 conforming to Swiss specification, and the fourteenth ground hole 214 and the fifteenth ground hole 215, together with a fifth hole set 50, conforming to two types of America 125V specifications. A third hole set 30 contains two symmetric plug holes conforming to global 250V specification's two flat pins or two round pins. A fourth hole set 40 contains two symmetric plug holes conforming to America 125V specification's two flat pints or two round pins. And the fifth hole set 50 contains two plug holes conforming to the America 125V specification with two flat pins. Especially, the third and fourth hole sets 30 and 40, together with the second hole set 20, jointly provide two plugs' simultaneous plugging.

Figure 3:
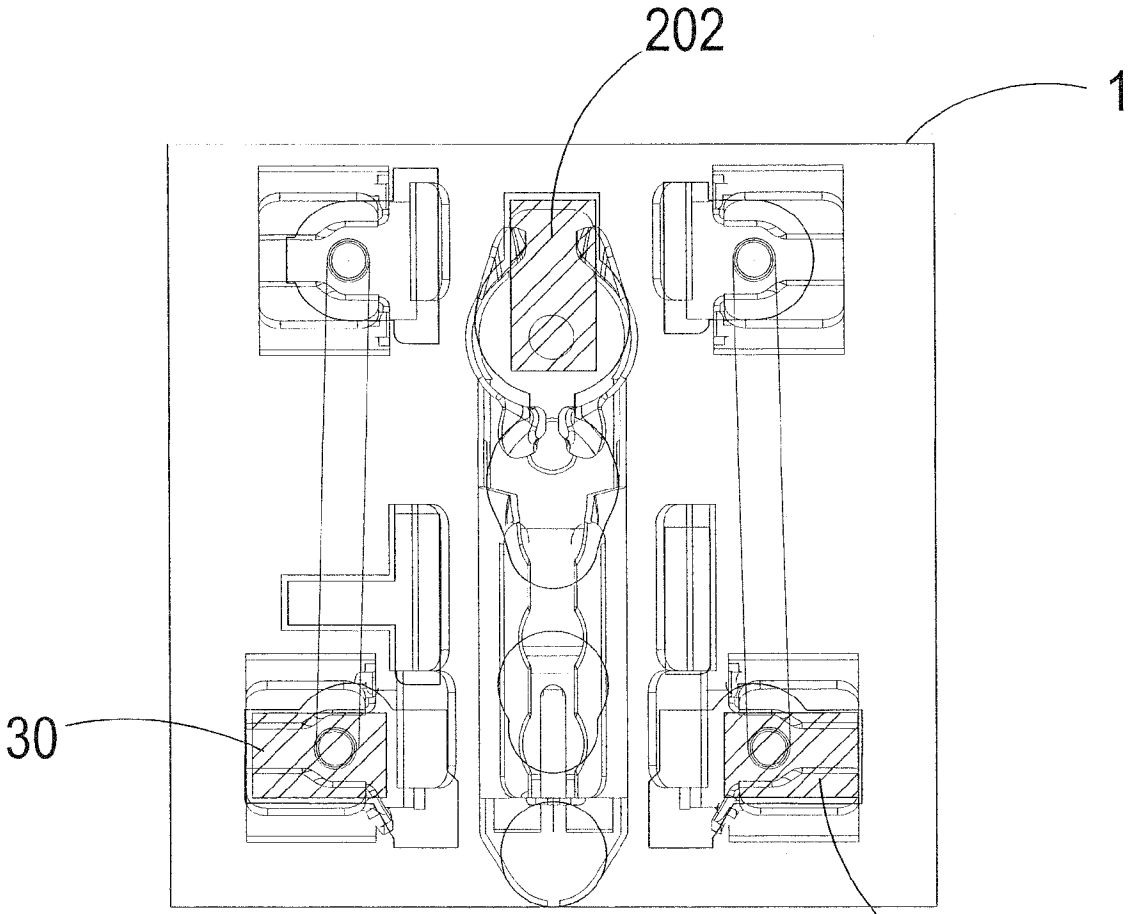
FIG. 3 is a schematic diagram showing a Britain plug received by a first embodiment of the present invention.
Figure 4:
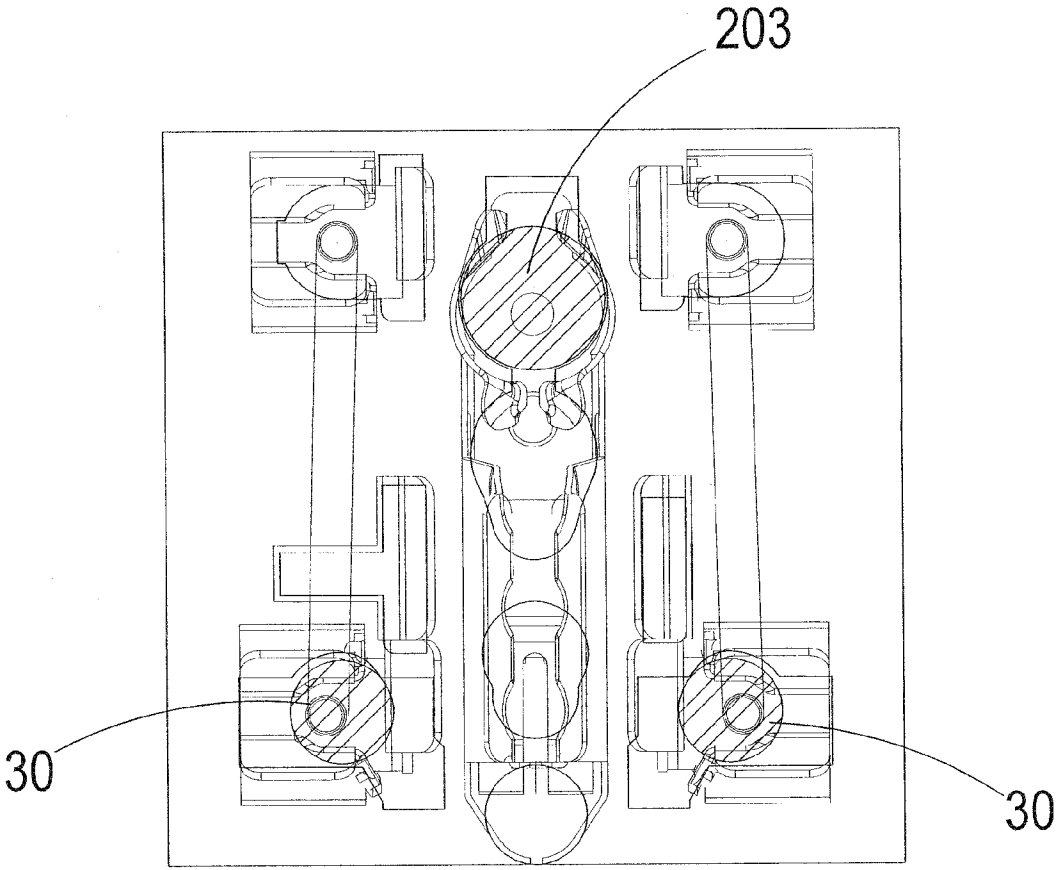
FIG. 4 is a schematic diagram showing an India plug received by a first embodiment of the present invention.
Figure 5:
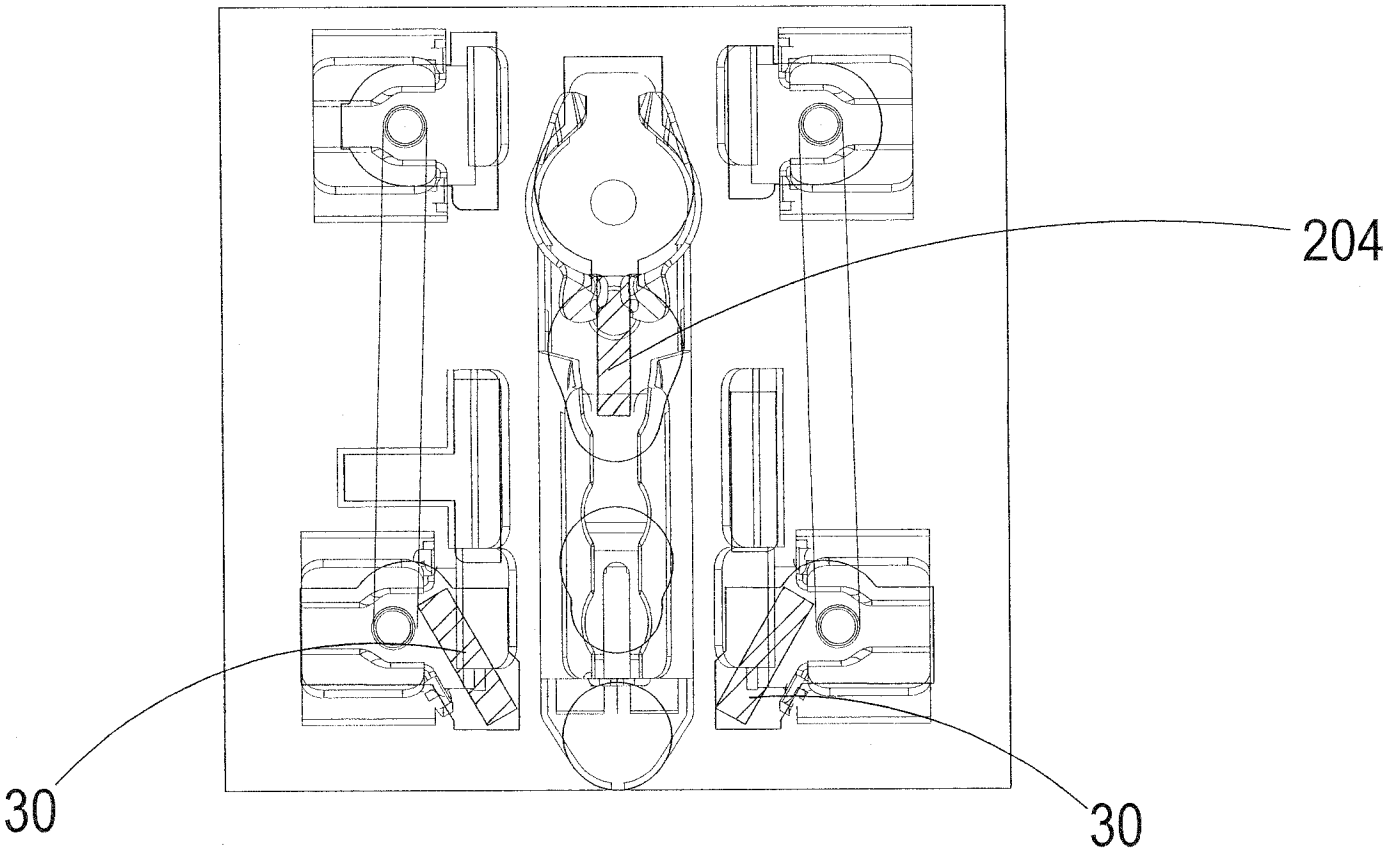
FIG. 5 is a schematic diagram showing one of a China and Australia 10 A and 16 A plugs received by a first embodiment of the present invention.
Figure 6:
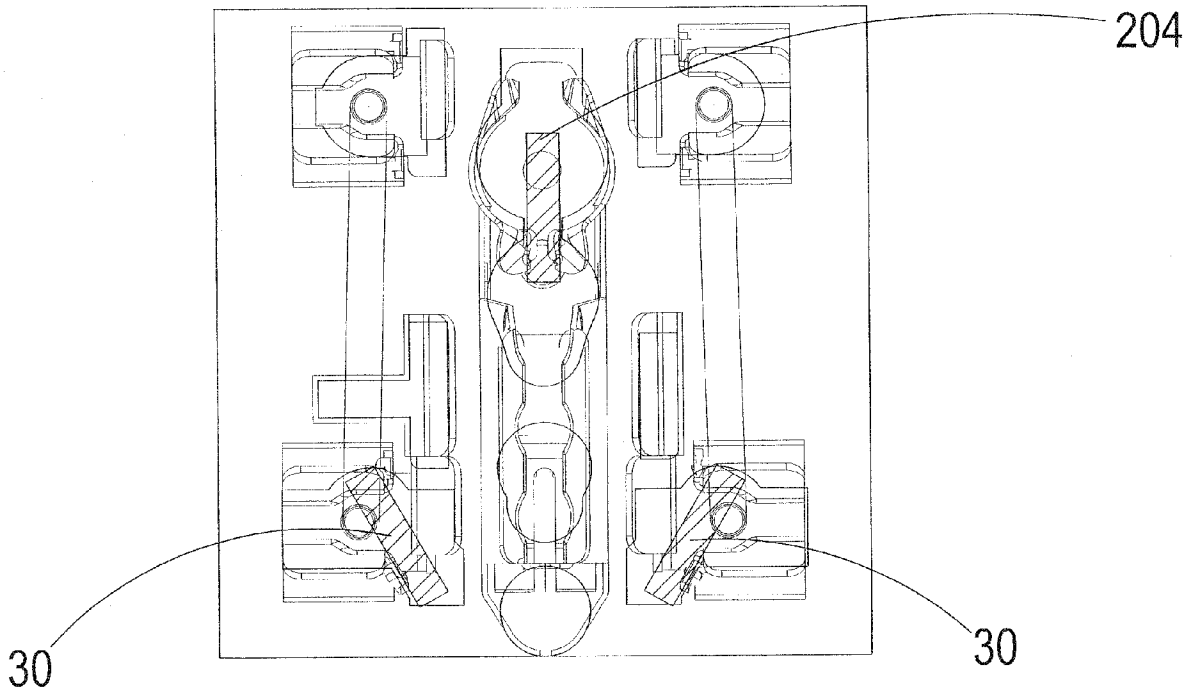
FIG. 6 is a schematic diagram showing one of a China and Australia 10 A and 16 A plugs received by a first embodiment of the present invention.
Figure 7:
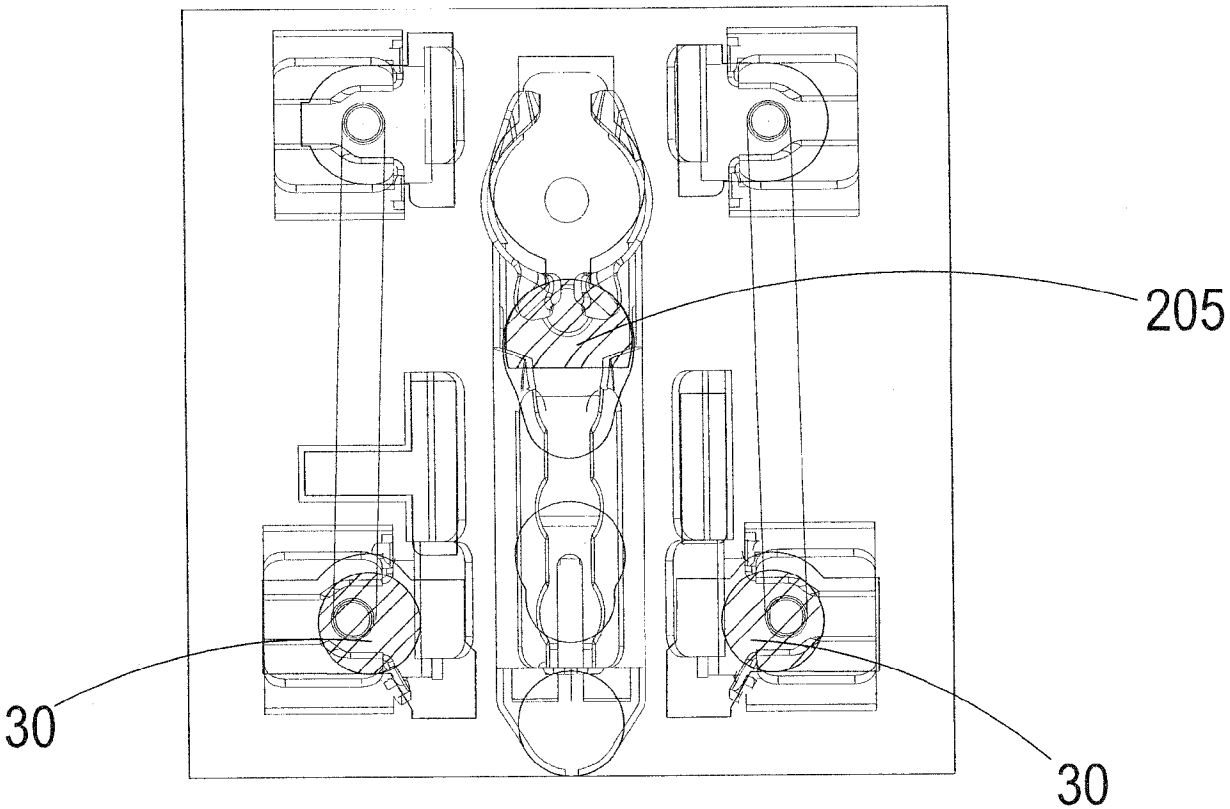
FIG. 7 is a schematic diagram showing a Denmark plug received by a first embodiment of the present invention.
Figure 8:
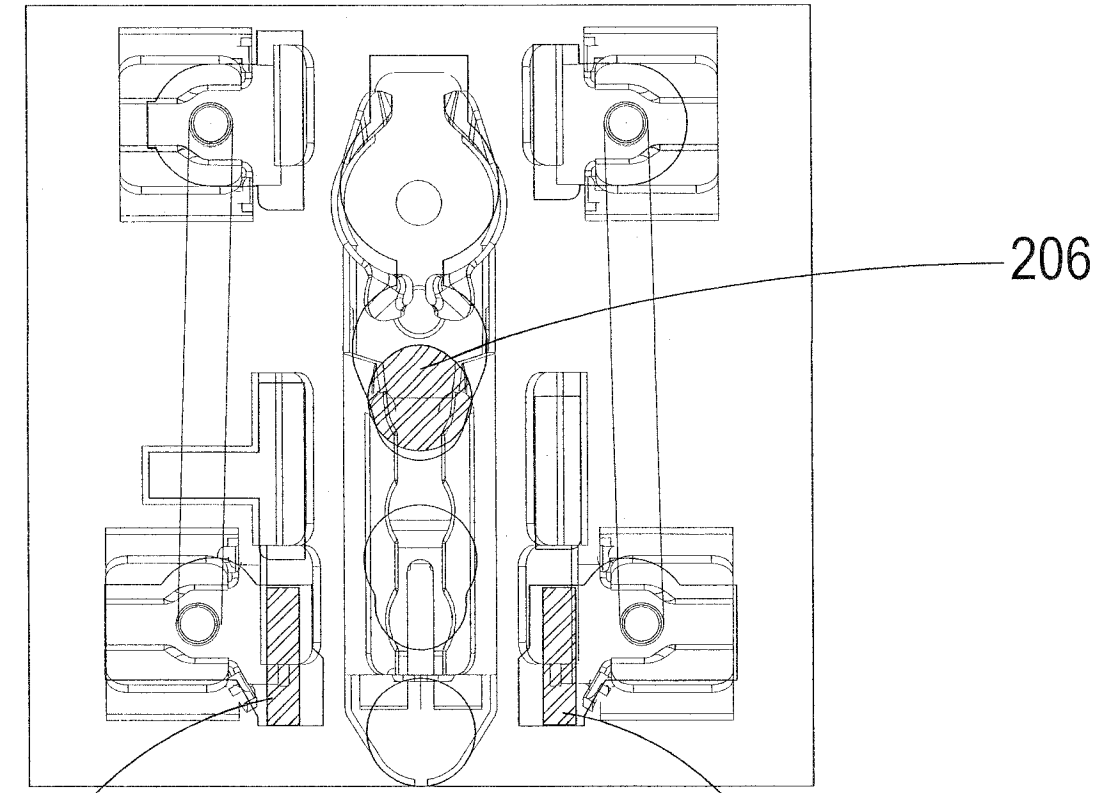
FIG. 8 is a schematic diagram showing a Philippine 10 A plug of America 250V received by a first embodiment of the present invention.
Figure 9:
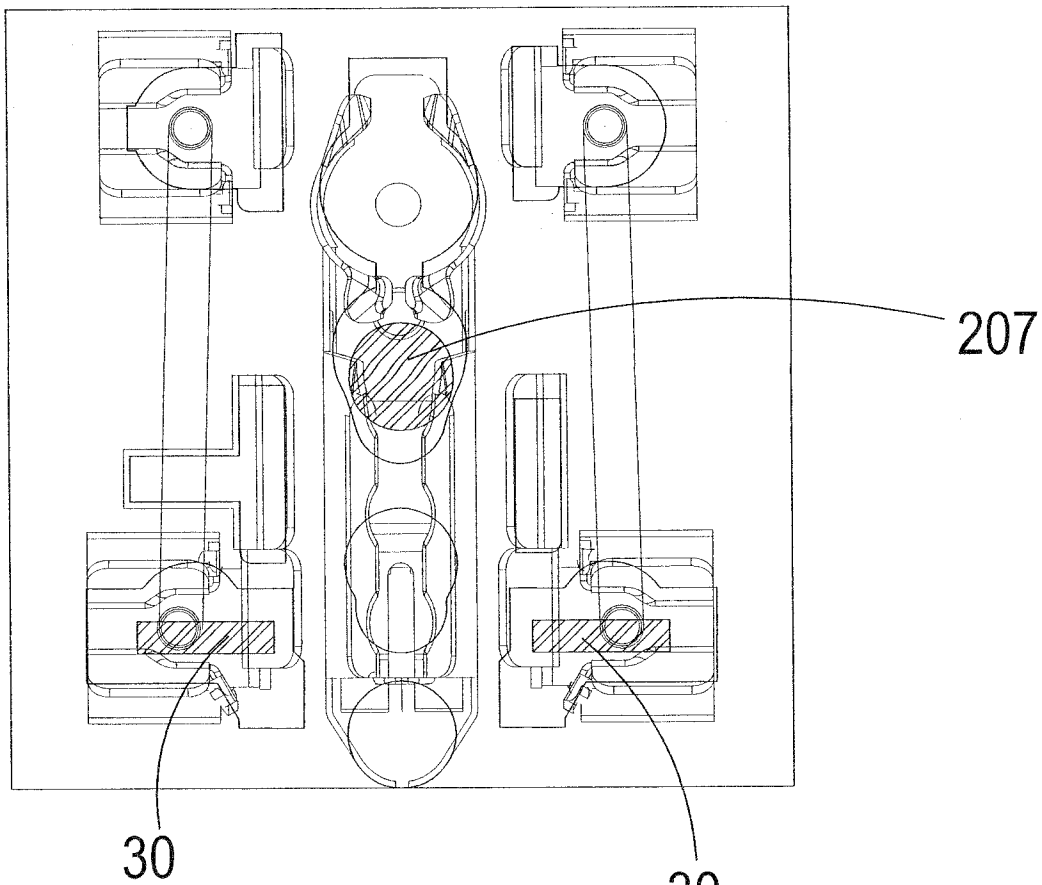
FIG. 9 is a schematic diagram showing an America 15 A plug received by a first embodiment of the present invention.
Figure 10:
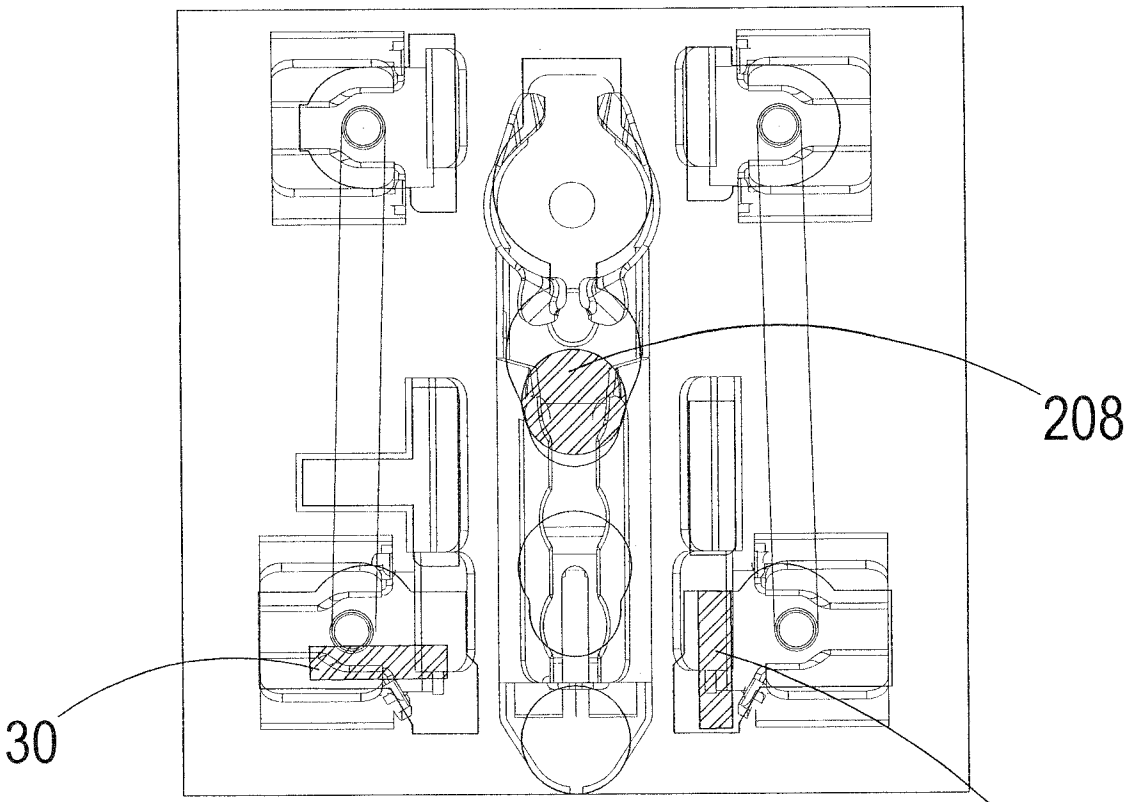
FIG. 10 is a schematic diagram showing America 20 A plug received by a first embodiment of the present invention.
Figure 11:
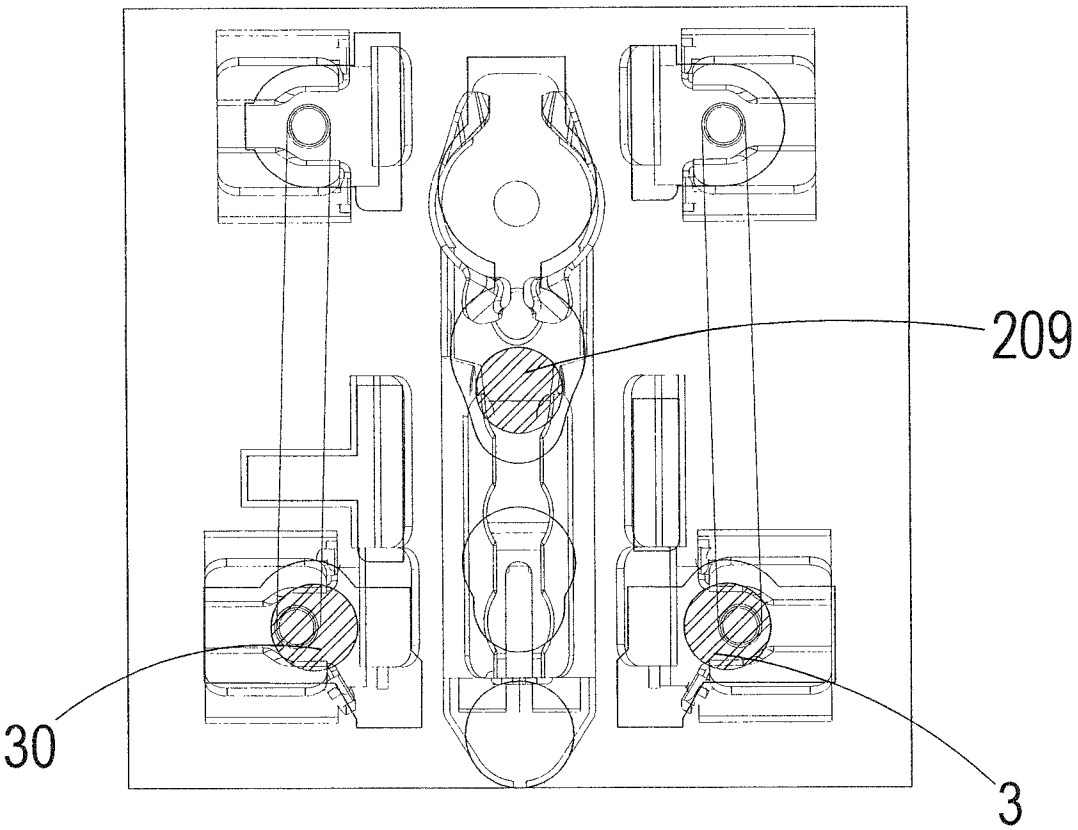
FIG. 11 is a schematic diagram showing a Middle East plug received by a first embodiment of the present invention.
Figure 12:
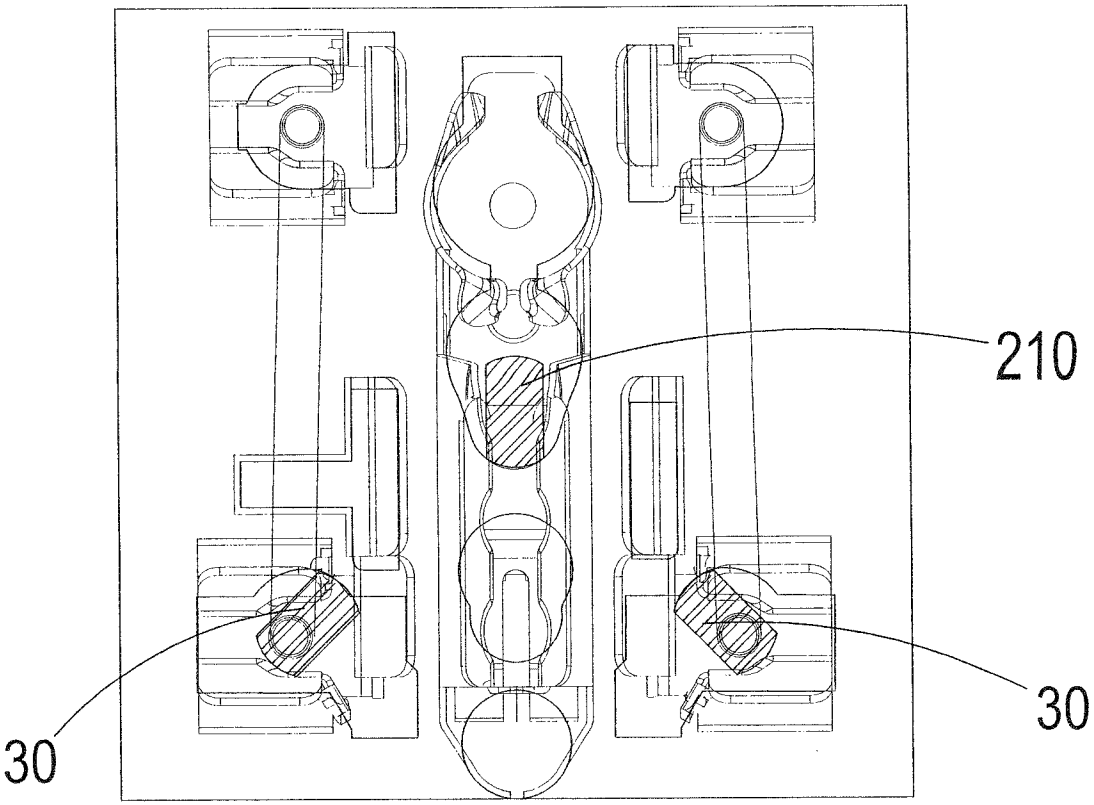
FIG. 12 is a schematic diagram showing an Israel plug received by a first embodiment of the present invention.
Figure 13:
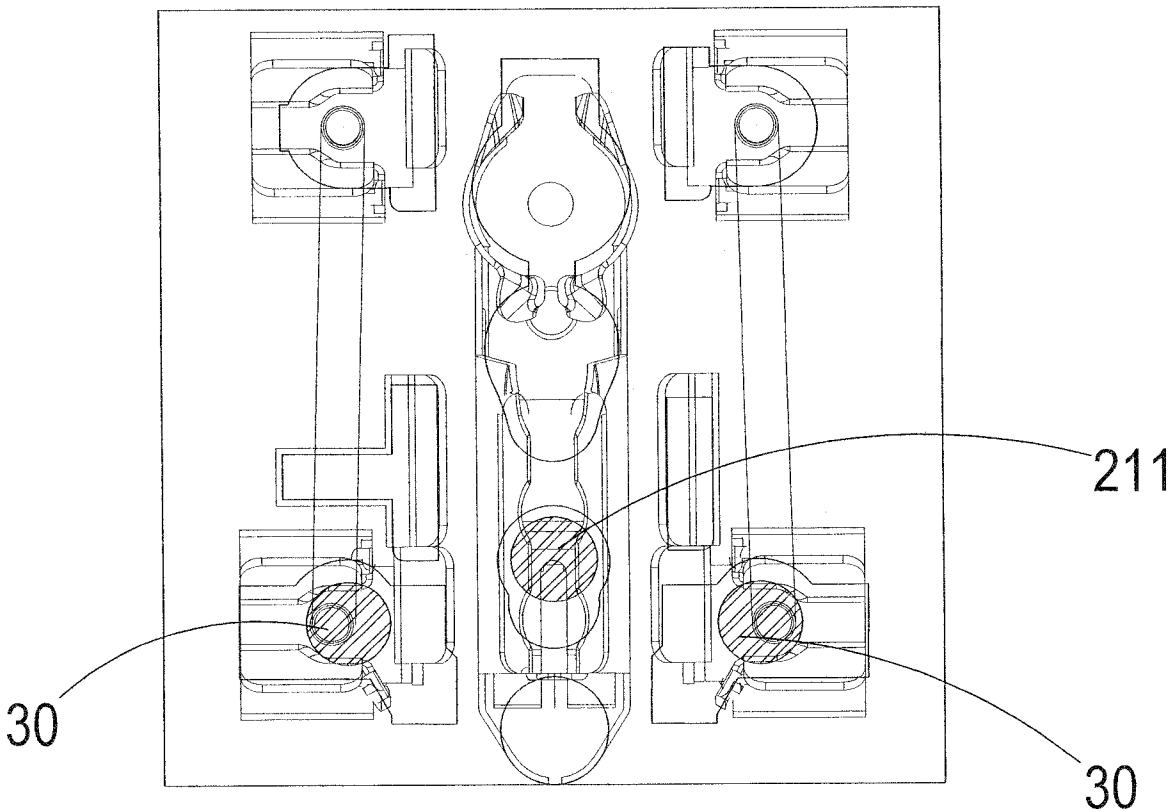
FIG. 13 is a schematic diagram showing a Brazil plug received by a first embodiment of the present invention.
Figure 14:
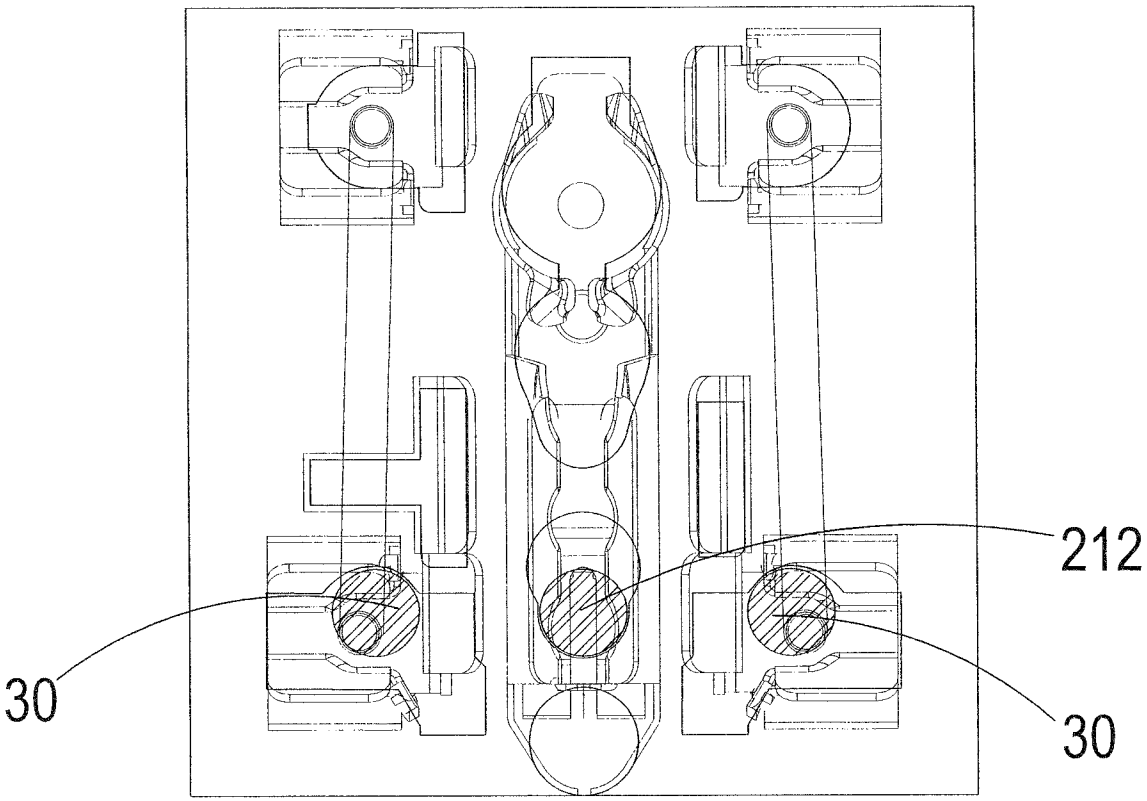
FIG. 14 is a schematic diagram showing a Brazil plug received by an Italy embodiment of the present invention.
Figure 15:
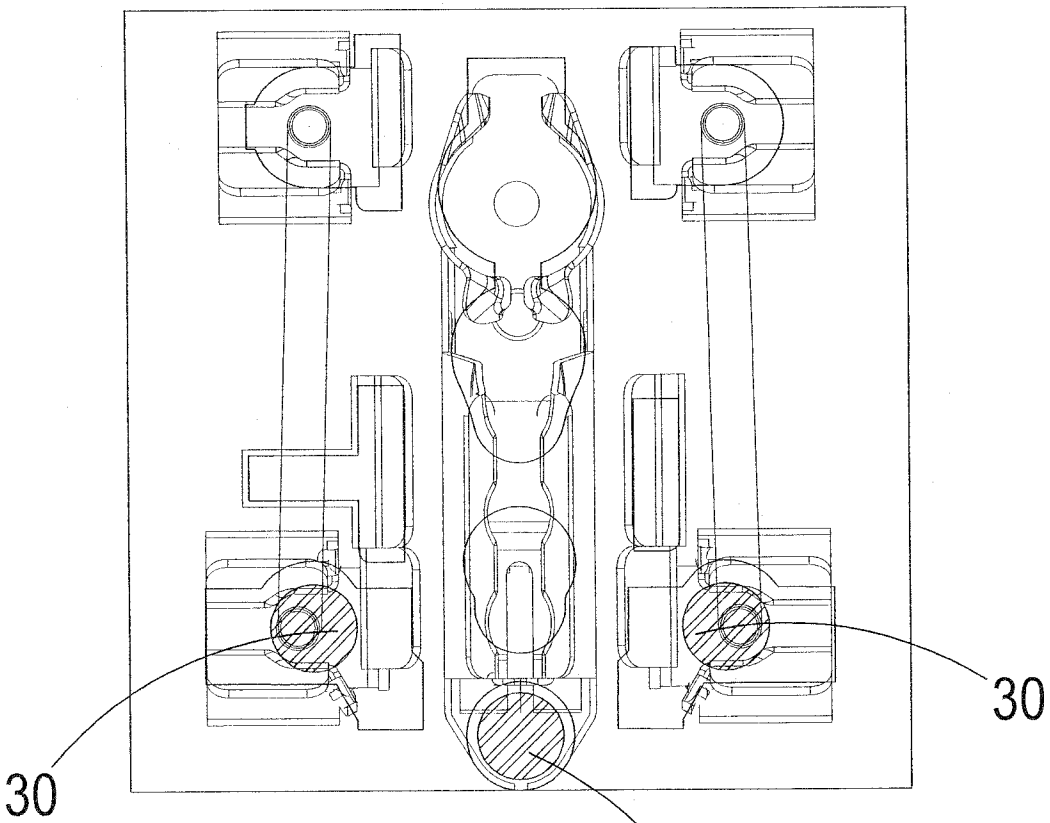
FIG. 15 is a schematic diagram showing a Swiss plug received by a first embodiment of the present invention.
Figure 16:
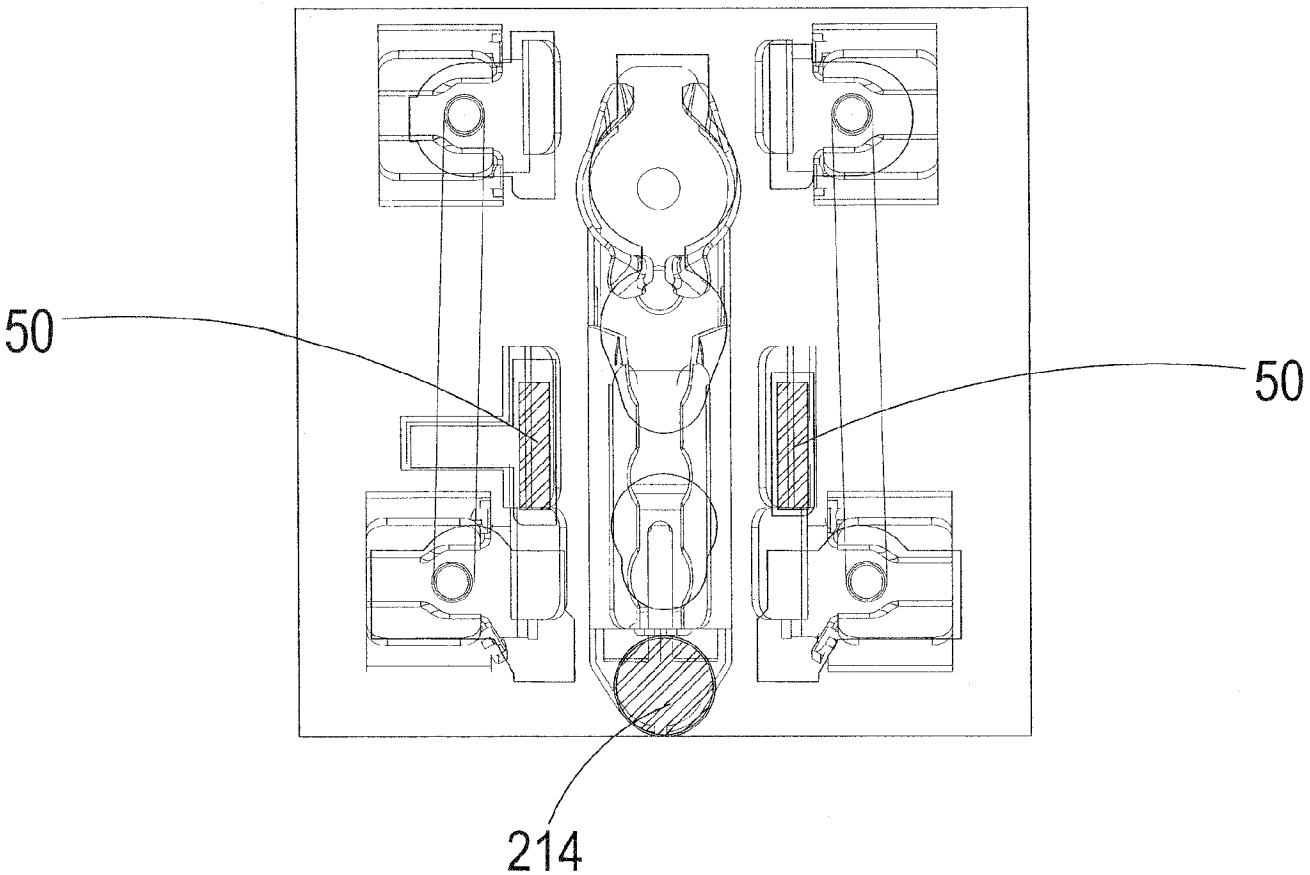
FIG. 16 is a schematic diagram showing a type of America 125V plug received by a first embodiment of the present invention.
Figure 17:
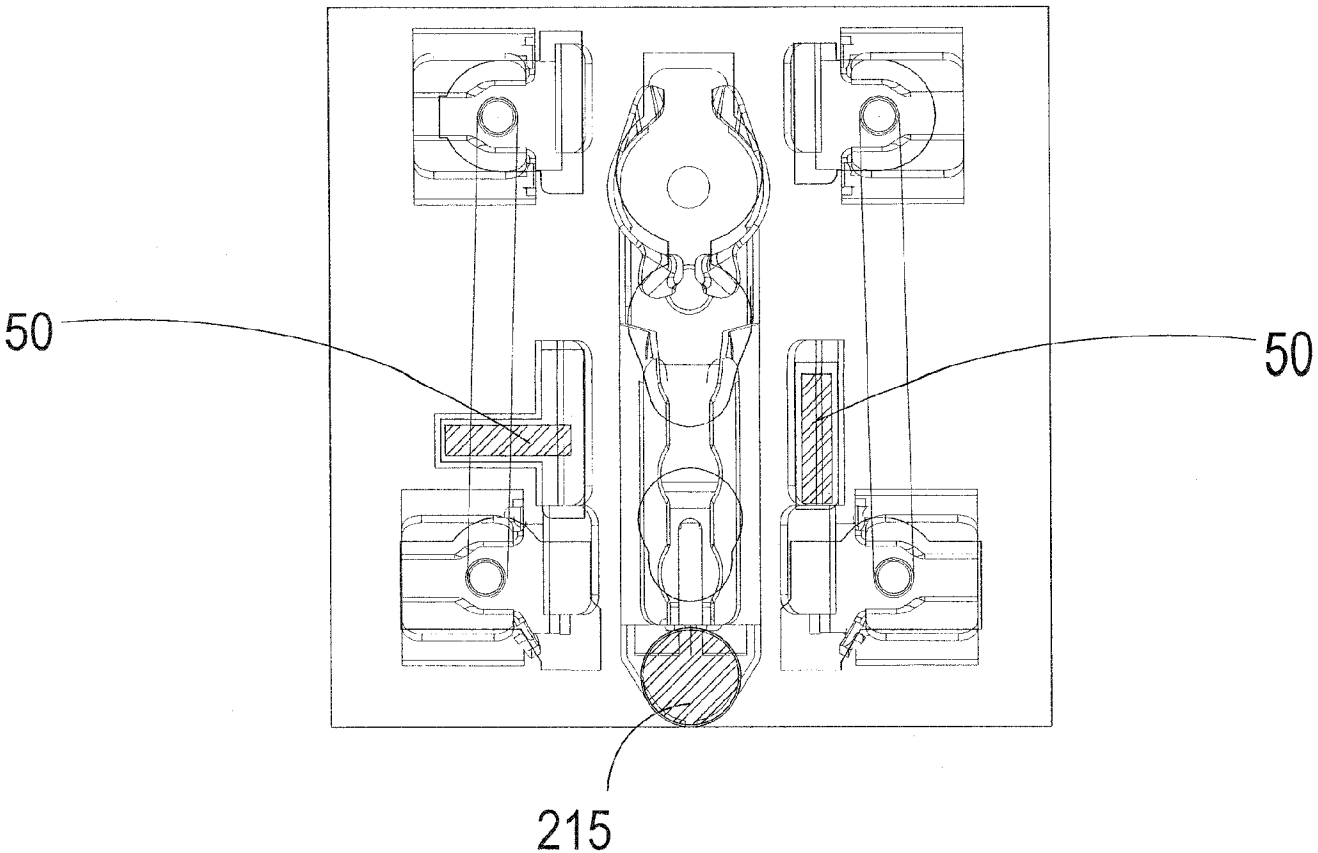
FIG. 17 is a schematic diagram showing another type of America 125V plug received by a first embodiment of the present invention.
Figure 18:
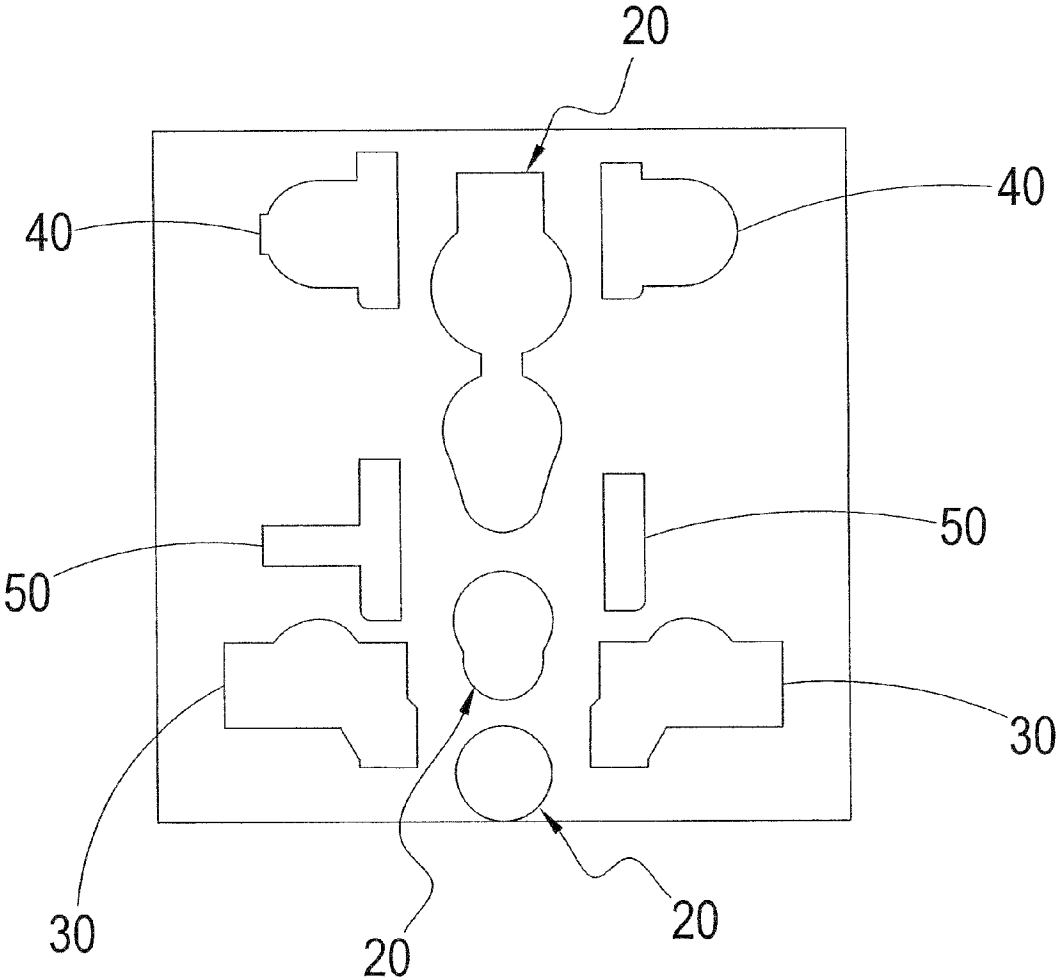
FIG. 18 is a schematic diagram showing a face plate according to a first embodiment of the present invention.

FIG. 18 shows a first embodiment of the universal plug adaptor. The various applications are described as follows. As shown in FIG. 3, when a Britain plug is plugged into the universal plug adaptor, the ground, live, and neutral pins are received by the second ground hole 202 and the plug holes of the third hole set 30, respectively. As shown in FIG. 4, when an India plug is plugged into the universal plug adaptor, the ground, live, and neutral pins are received by the third ground hole 203 and the plug holes of the third hole set 30, respectively. As shown in FIGS. 5 and 6, when a 10 A and 16 A China or Australia plug is plugged into the universal plug adaptor, the ground, live, and neutral pins are received by the fourth ground hole 204 and the plug holes of the third hole set 30, respectively. As shown in FIG. 7, when a Denmark plug is plugged into the universal plug adaptor, the ground, live, and neutral pins are received by the fifth ground hole 205 and the plug holes of the third hole set 30, respectively. As shown in FIG. 8, when a 10 A Philippine plug of America 250V specification is plugged into the universal plug adaptor, the ground, live, and neutral pins are received by the sixth ground hole 206 and the plug holes of the third hole set 30, respectively. As shown in FIG. 9, when a 15 A America plug is plugged into the universal plug adaptor, the ground, live, and neutral pins are received by the seventh ground hole 207 and the plug holes of the third hole set 30, respectively. As shown in FIG. 10, when a 20 A America plug is plugged into the universal plug adaptor, the ground, live, and neutral pins are received by the eighth ground hole 208 and the plug holes of the third hole set 30, respectively. As shown in FIG. 11, when a Middle East plug is plugged into the universal plug adaptor, the ground, live, and neutral pins are received by the ninth ground hole 209 and the plug holes of the third hole set 30, respectively. As shown in FIG. 12, when an Israel plug is plugged into the universal plug adaptor, the ground, live, and neutral pins are received by the tenth ground hole 210 and the plug holes of the third hole set 30, respectively. As shown in FIG. 13, when a Brazil plug is plugged into the universal plug adaptor, the ground, live, and neutral pins are received by the eleventh ground hole 211 and the plug holes of the third hole set 30, respectively. As shown in FIG. 14, when an Italy plug is plugged into the universal plug adaptor, the ground, live, and neutral pins are received by the twelfth ground hole 212 and the plug holes of the third hole set 30, respectively. As shown in FIG. 15, when a Swiss plug is plugged into the universal plug adaptor, the ground, live, and neutral pins are received by the thirteenth ground hole 213 and the plug holes of the third hole set 30, respectively. As shown in FIGS. 16 and 17, when one of the two America 125V plug is plugged into the universal plug adaptor, the ground pins are received by the fourteenth and fifteenth ground holes 214 and 215, respectively, and the live and neutral pins are received by the plug holes of the fifth hole set 50, respectively. Additionally, depending on the requirement, the second hole set 20 can be configured with the fourth hole set 40 and the fifth hole set 50, in addition to the configuration with the third hole set 30.

Figure 19:
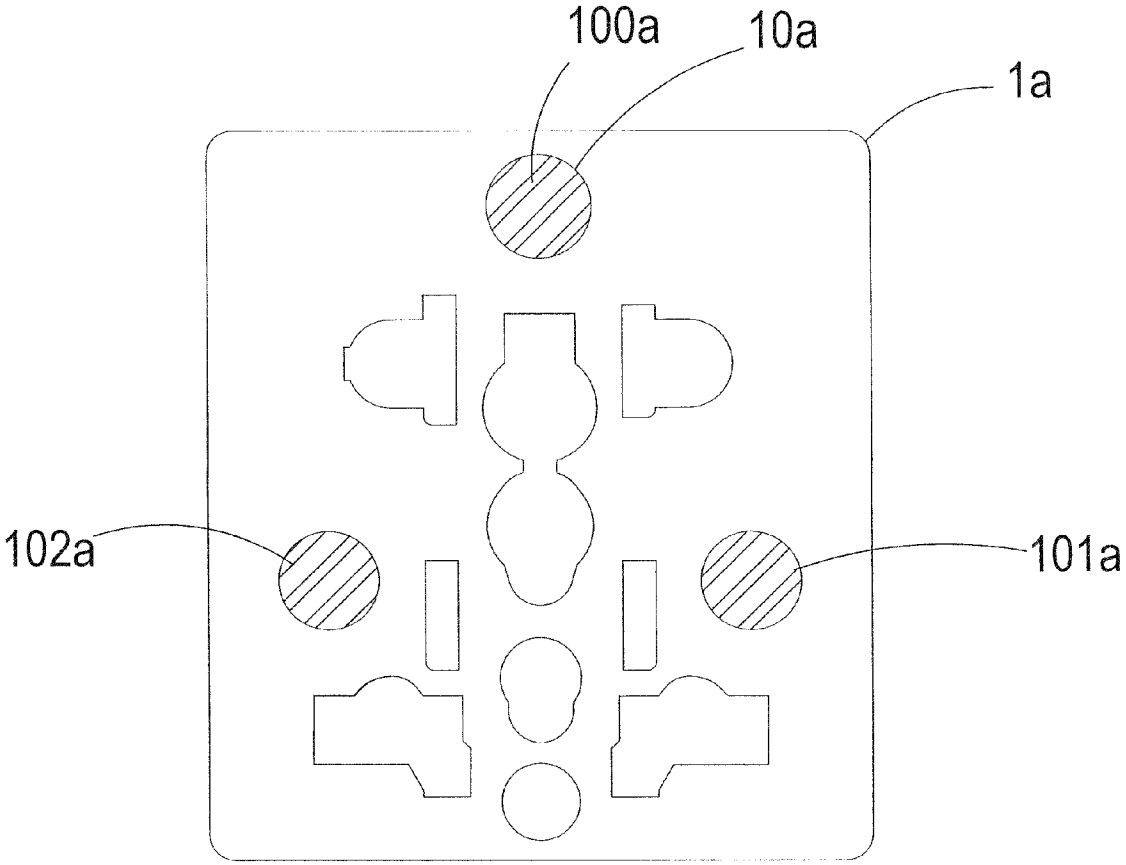
FIG. 19 is a schematic diagram showing a South Africa plug received by a preferred embodiment of the present invention.
Figure 20:
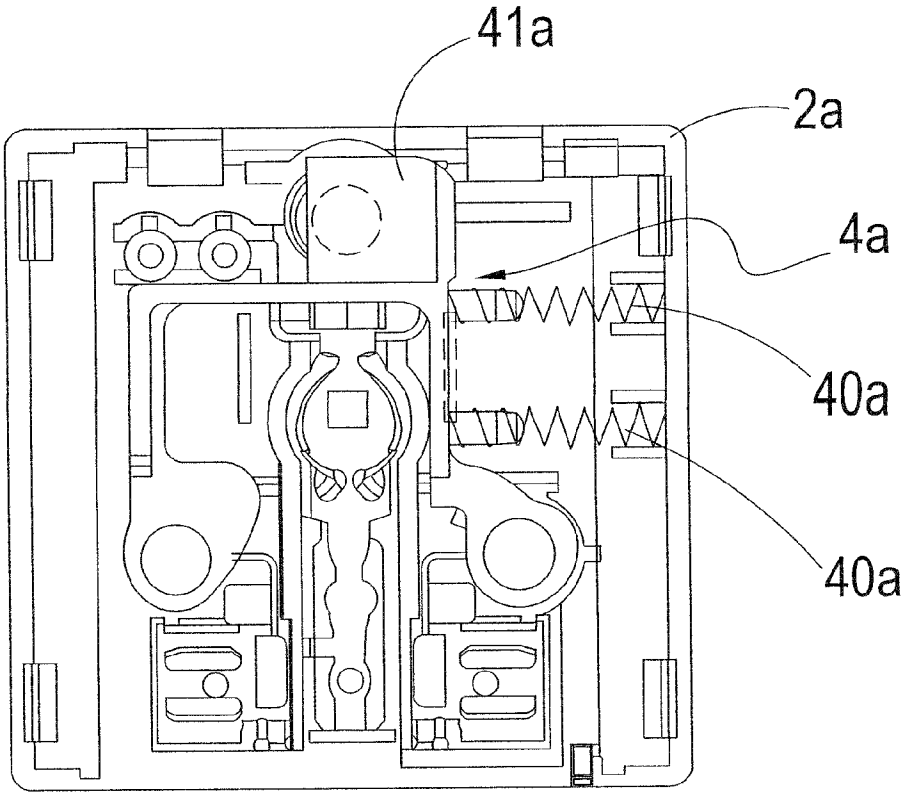
FIG. 20 is a schematic diagram showing the safety-door device of a preferred embodiment of the present invention.
Figure 21:
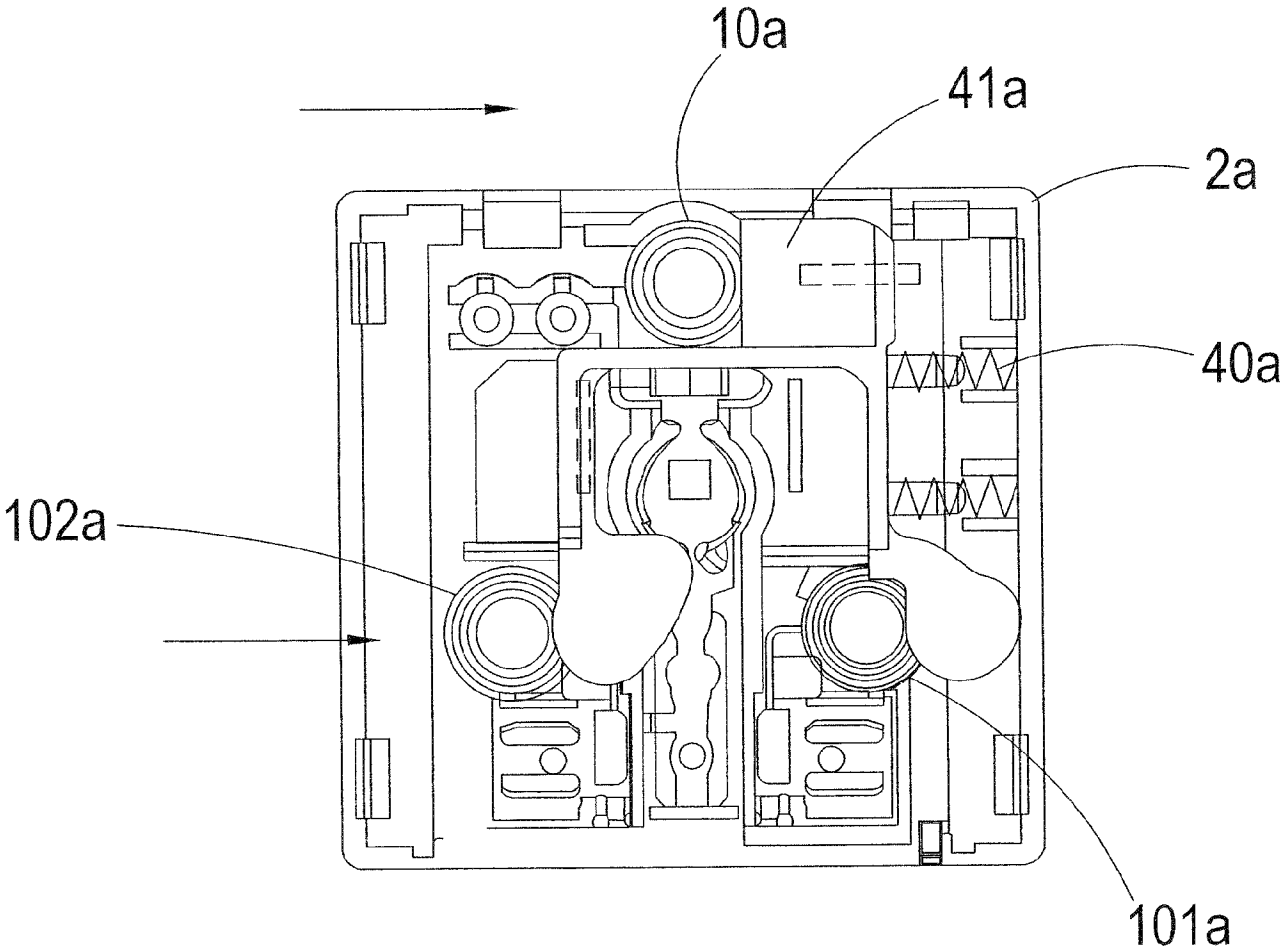
FIG. 21 is a schematic diagram showing the safety-door device when a South Africa plug is received by a preferred embodiment of the present invention.

FIGS. 19 to 21 show a preferred embodiment of the universal plug adaptor for plugs conforming to the South Africa specification. As illustrated, a safety-door device 4*a* is configured between the face plate 1*a* and the casing 2*a*, corresponding to a first hole set 10*a*, a first live hole 101*a*, a first neutral hole 102*a*. The safety-door device 4*a* contains a number of elastic elements 40*a* (such as springs) and at least a guiding slope 41*a* for triggering the safety-door device 4*a*'s confined movement. When a South Africa plug is plugged, the guiding slope 41*a* is engaged, the safety-door device 4*a* is moved towards a preset direction, and the elastic elements 40*a* are compressed. The ground, live, and neutral pins of the South Africa plug are then received by the first ground hole 100*a*, the first live hole 101*a*, and the first neutral hole 102*a*. When the South Africa plug is unplugged, the safety-door device 4*a* is restored to its original position by the expansion of the elastic elements 40*a*. As such, the safety-door device 4*a* is able to prevent miscellaneous articles from entering the universal plug adaptor and causing short circuit or other accidents.

Figure 22:
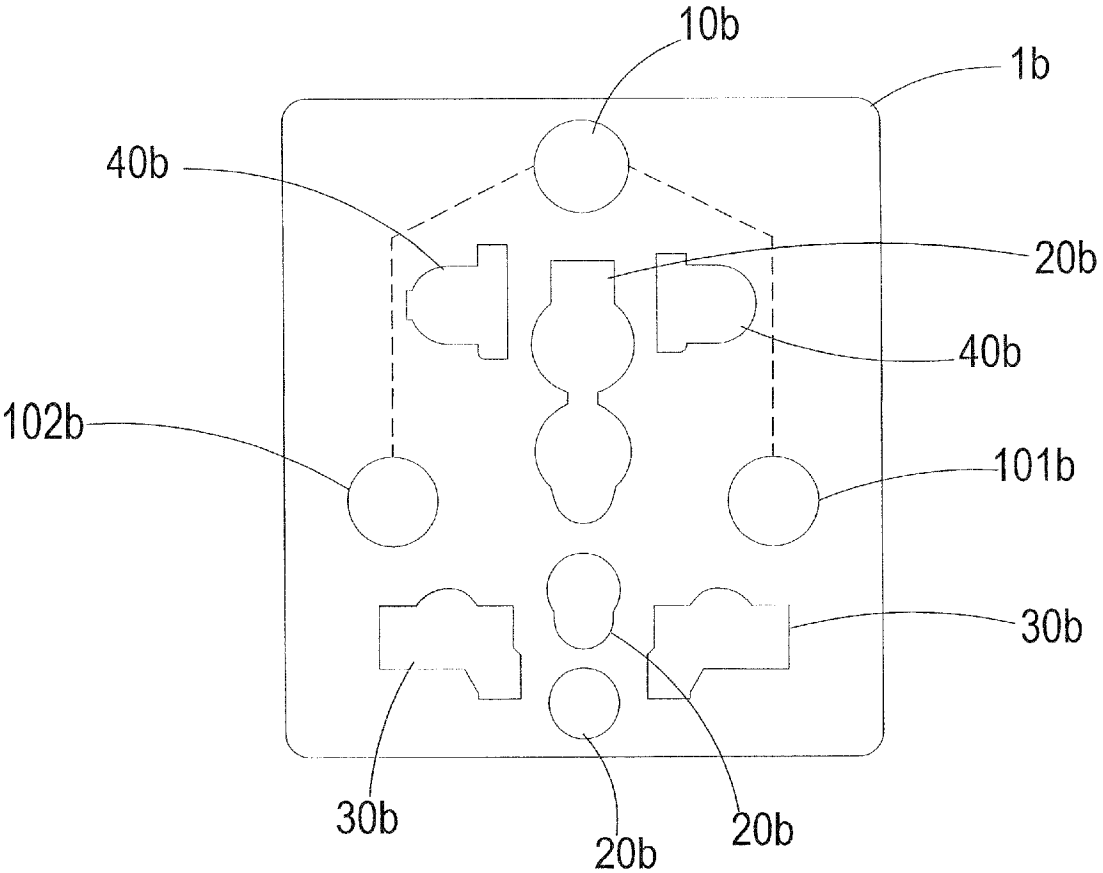
FIG. 22 is a schematic diagram showing a face plate according to a third embodiment of the present invention.

FIG. 22 shows a third embodiment of the universal plug adaptor. As illustrated, the face plate 1*b* contains a first hole set 10*b*, a second hole set 20*b*, a third hold set 30*b*, a fourth hole set 40*b*, and a first live hole 101*b* and a first neutral hole 102*b* corresponding to the first hole set 10*b*.

Figure 23:
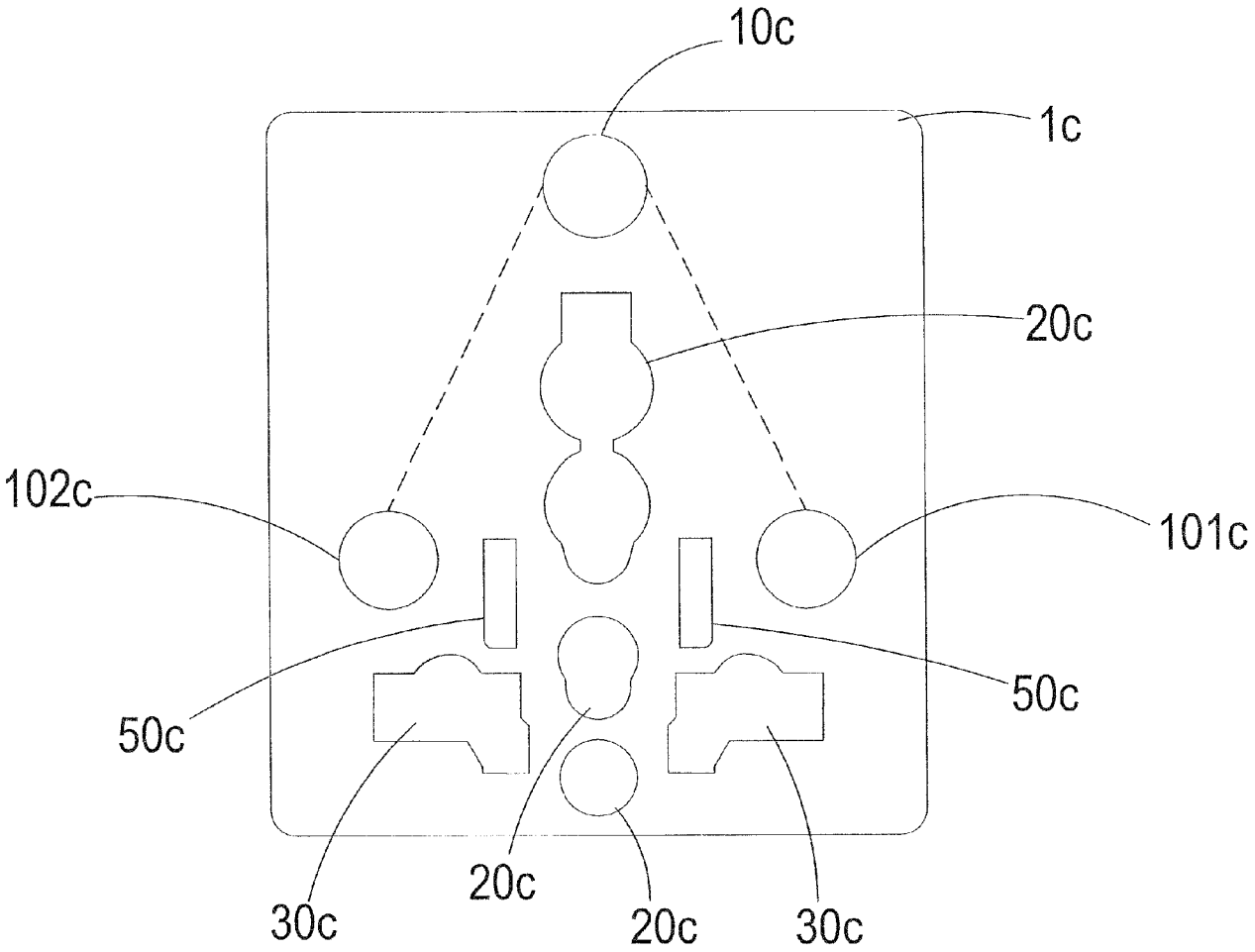
FIG. 23 is a schematic diagram showing a face plate according to a fourth embodiment of the present invention.

FIG. 23 shows a fourth embodiment of the universal plug adaptor. As illustrated, the face plate 1*c* contains a first hole set 10*c*, a second hole set 20*c*, a third hold set 30*c*, a fifth hole set 50*c*, and a first live hole 101*c* and a first neutral hole 102*c* corresponding to the first hole set 10*c*.

Figure 24:
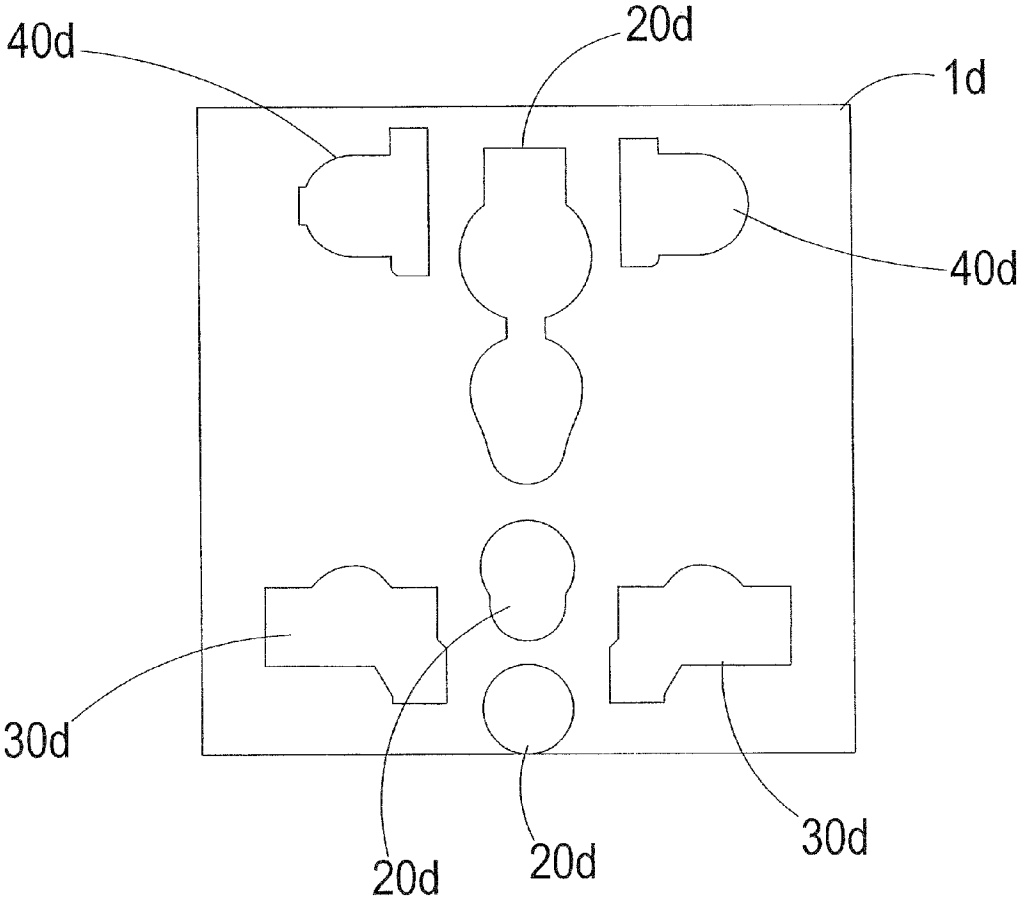
FIG. 24 is a schematic diagram showing a face plate according to a fifth embodiment of the present invention.

FIG. 24 shows a fifth embodiment of the universal plug adaptor. As illustrated, the face plate 1*d* contains a second hole set 20*d*, a third hold set 30*d*, and a fourth hole set 40*d*. Please note that the present embodiment allows the simultaneous plugging of two types of plugs.

Figure 25:
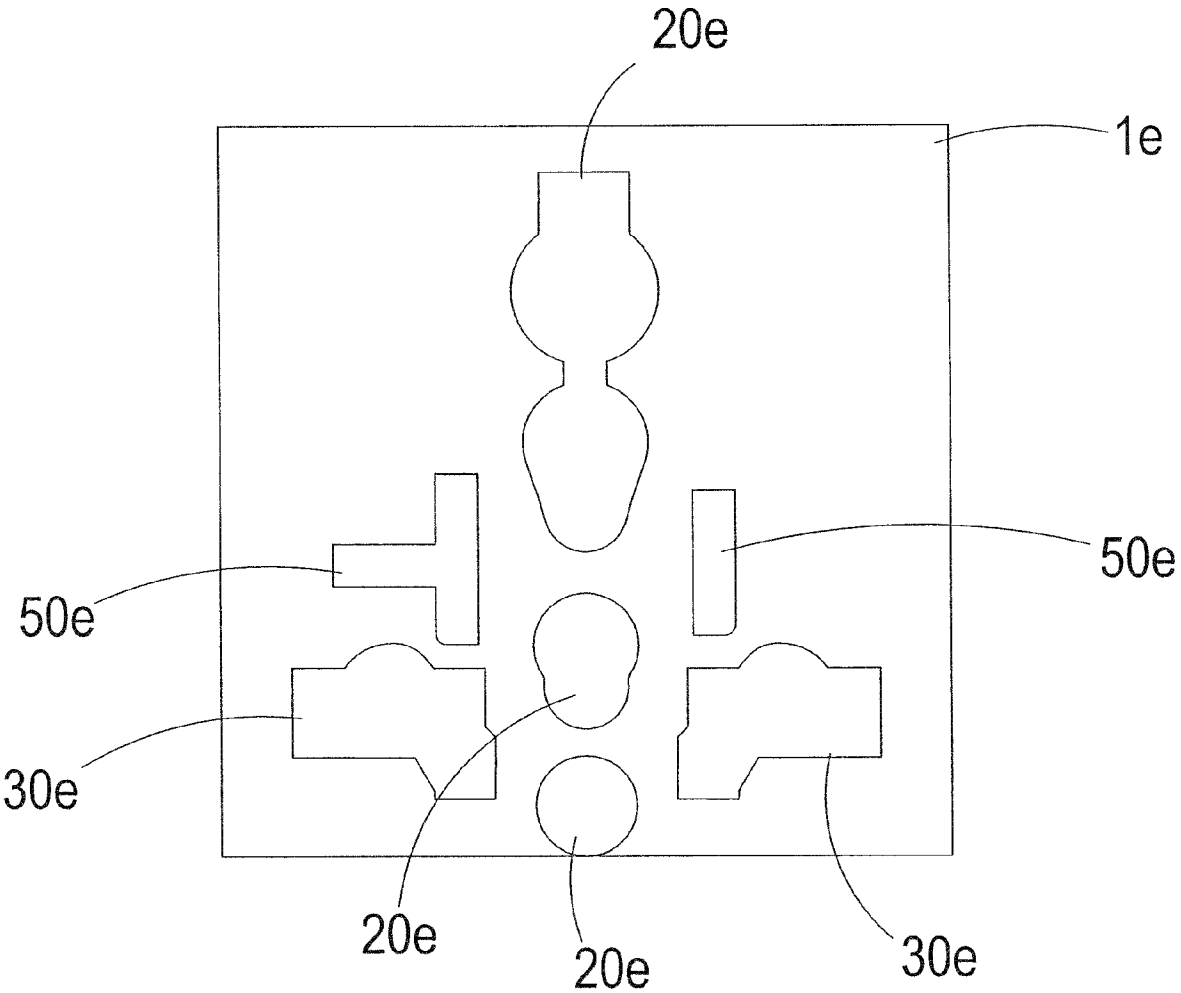
FIG. 25 is a schematic diagram showing a face plate according to a sixth embodiment of the present invention.

FIG. 25 shows a sixth embodiment of the universal plug adaptor. As illustrated, the face plate le contains a second hole set 20*e*, a third hold set 30*e*, and a fifth hole set 50*e*. Please note that one of the plug holes of the fifth hole set 50*e* is T-shaped.

Figure 26:
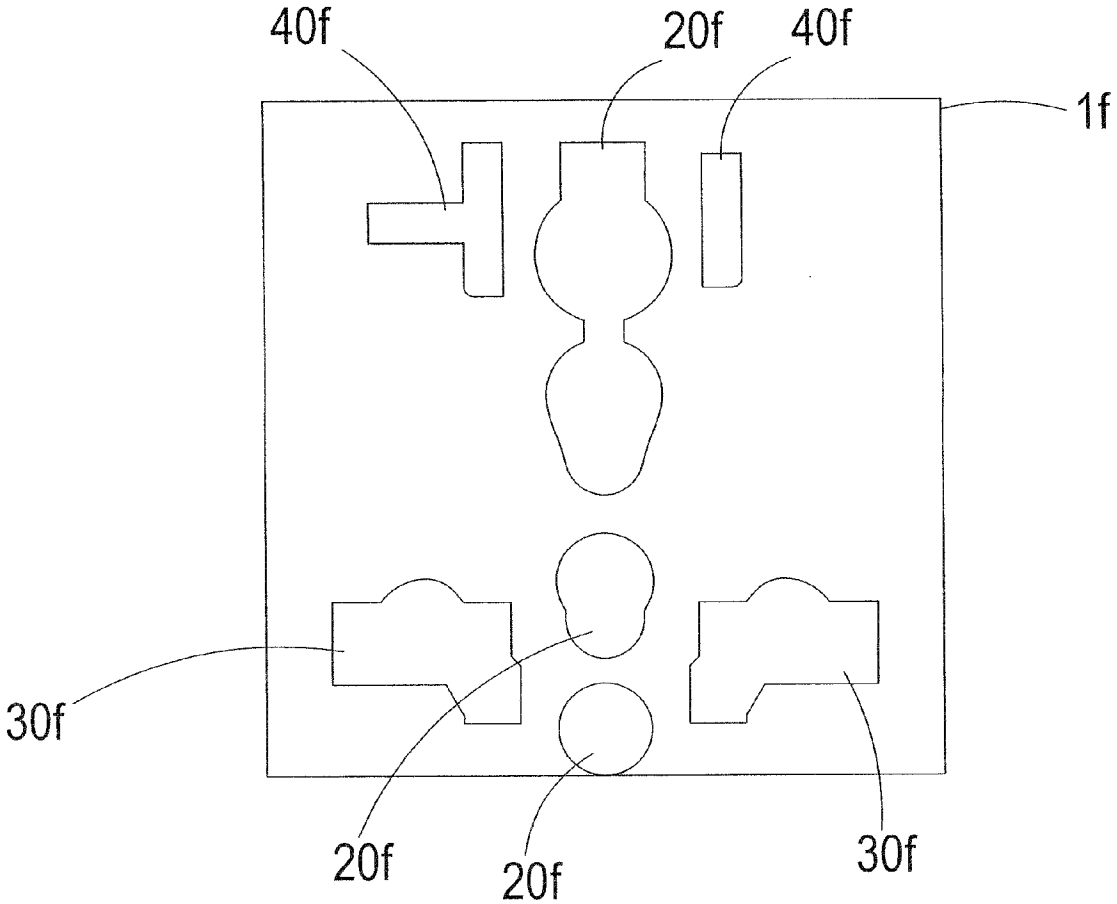
FIG. 26 is a schematic diagram showing a face plate according to a seventh embodiment of the present invention.
Figure 26A:
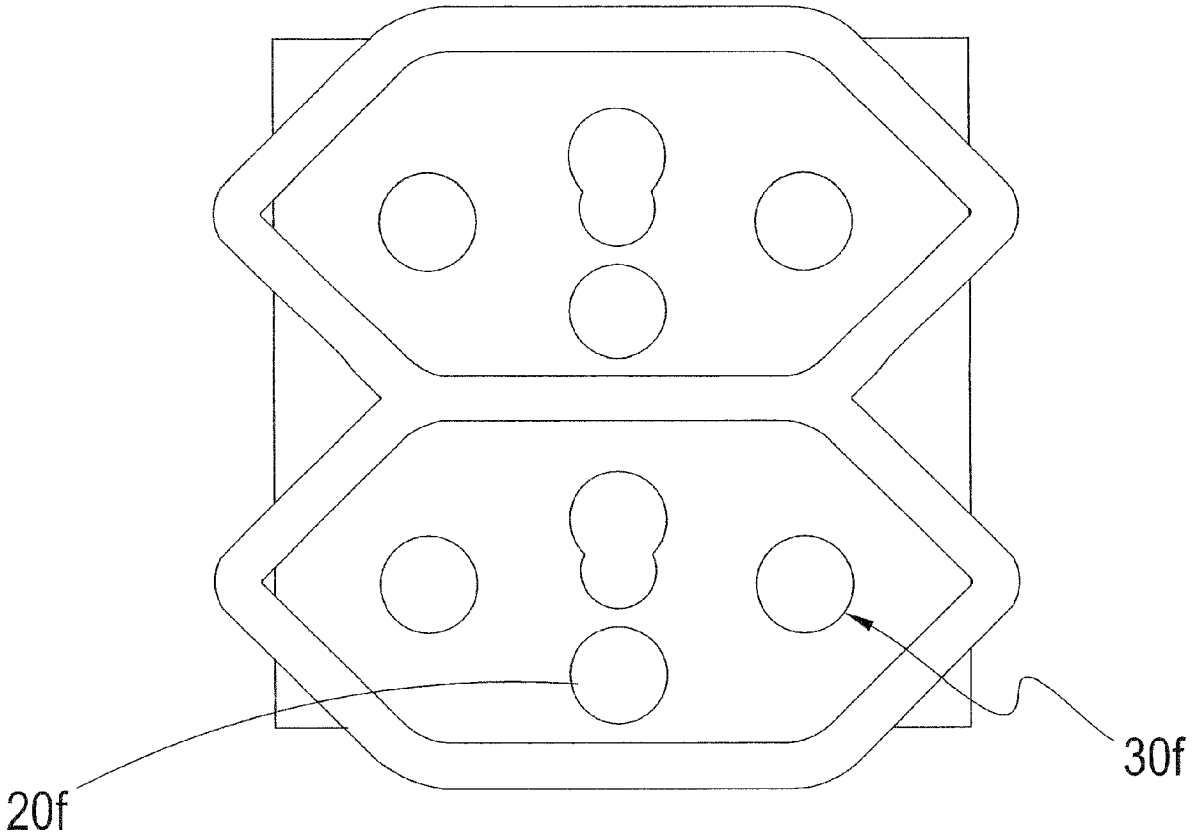
FIG. 26A is a schematic diagram showing a variation of the face plate according to a seventh embodiment of the present invention.
Figure 26B:
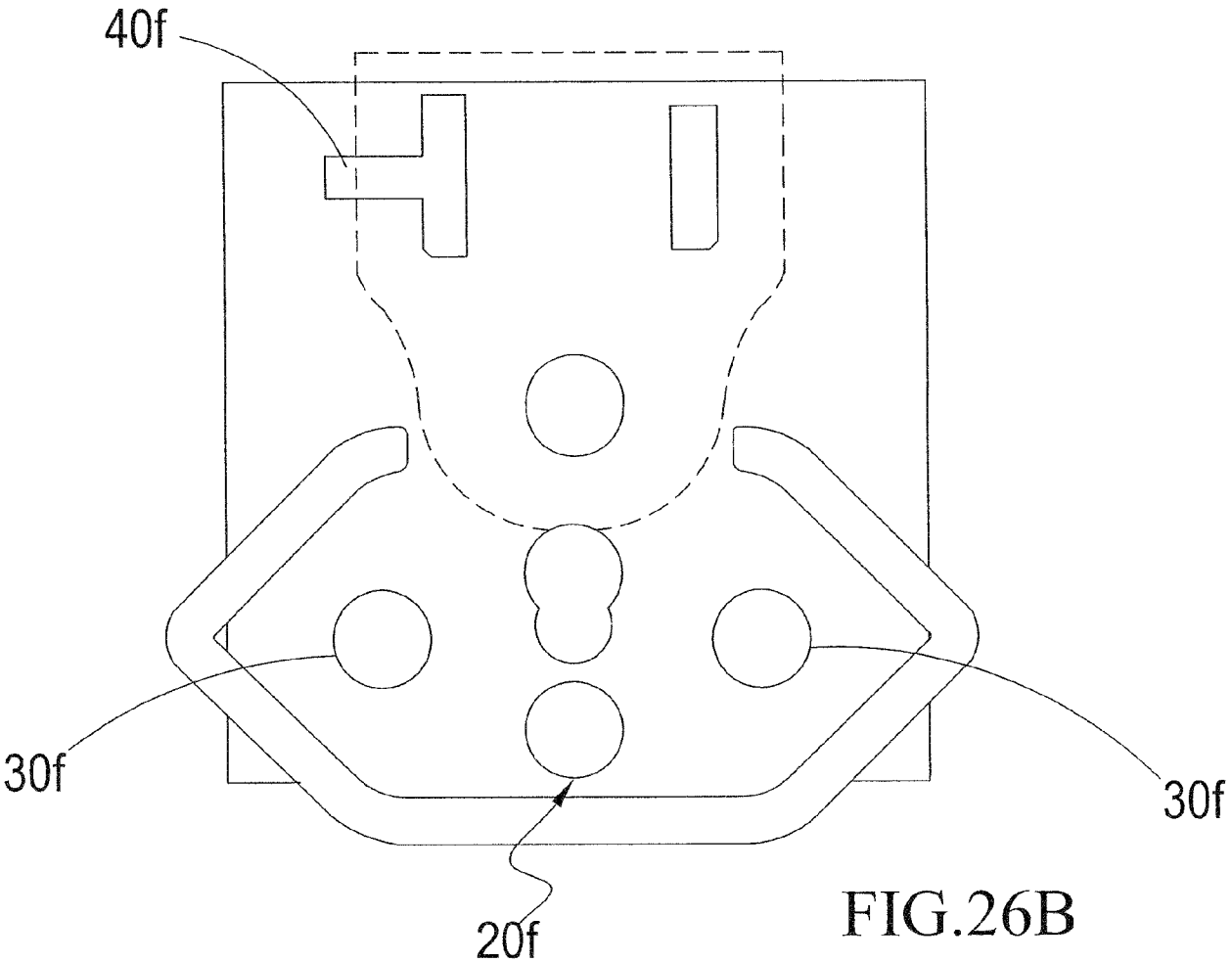
FIG. 26B is a schematic diagram showing another variation of the face plate according to a seventh embodiment of the present invention.
Figure 27:
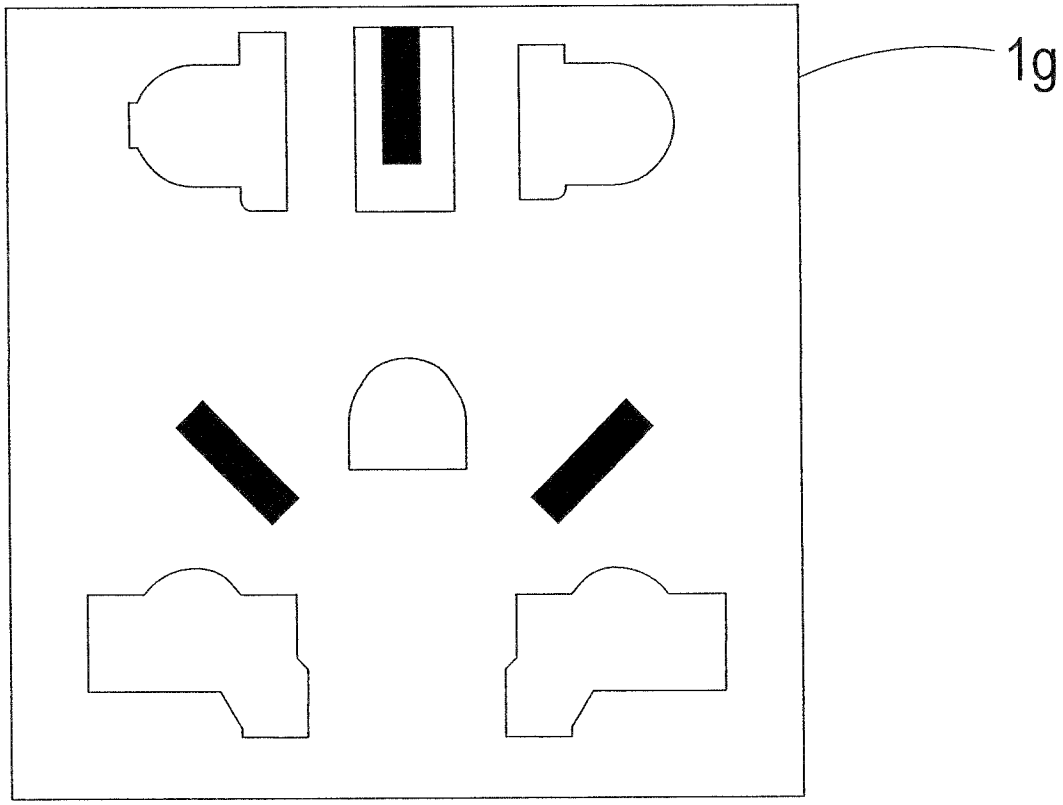
FIG. 27 is a schematic diagram showing a face plate according to an eighth embodiment of the present invention.
Figure 28:
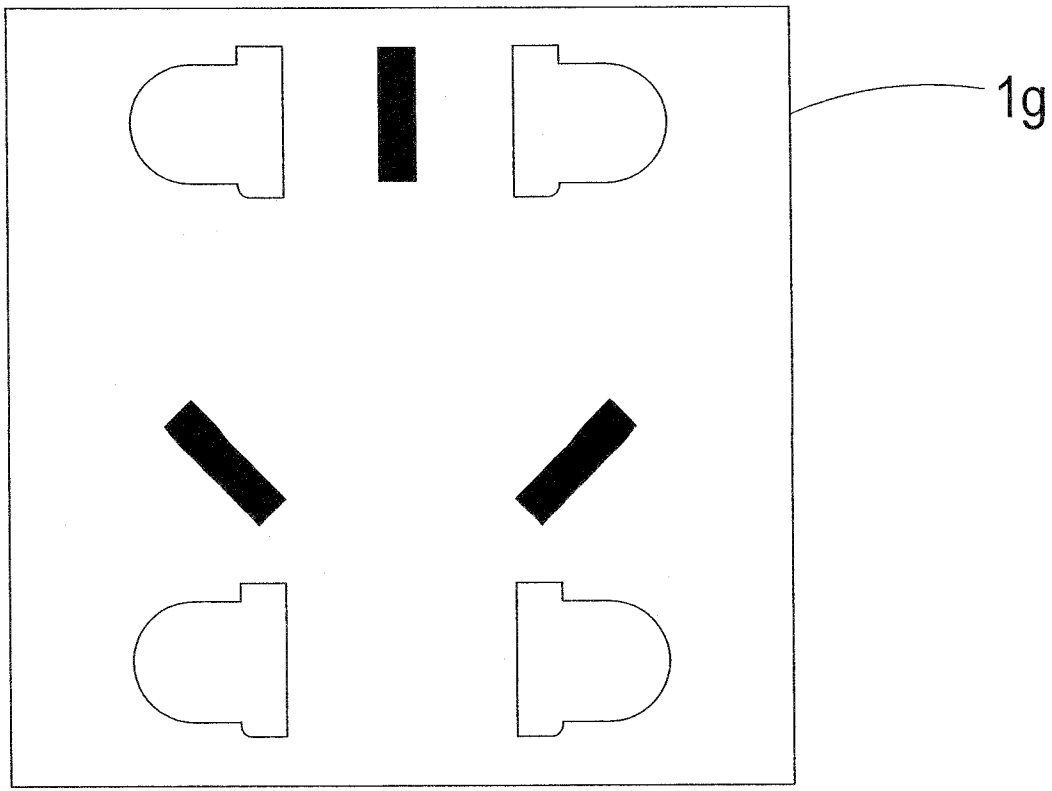
FIG. 28 is a schematic diagram showing a variation of the face plate according to an eighth embodiment of the present invention.
Figure 29:
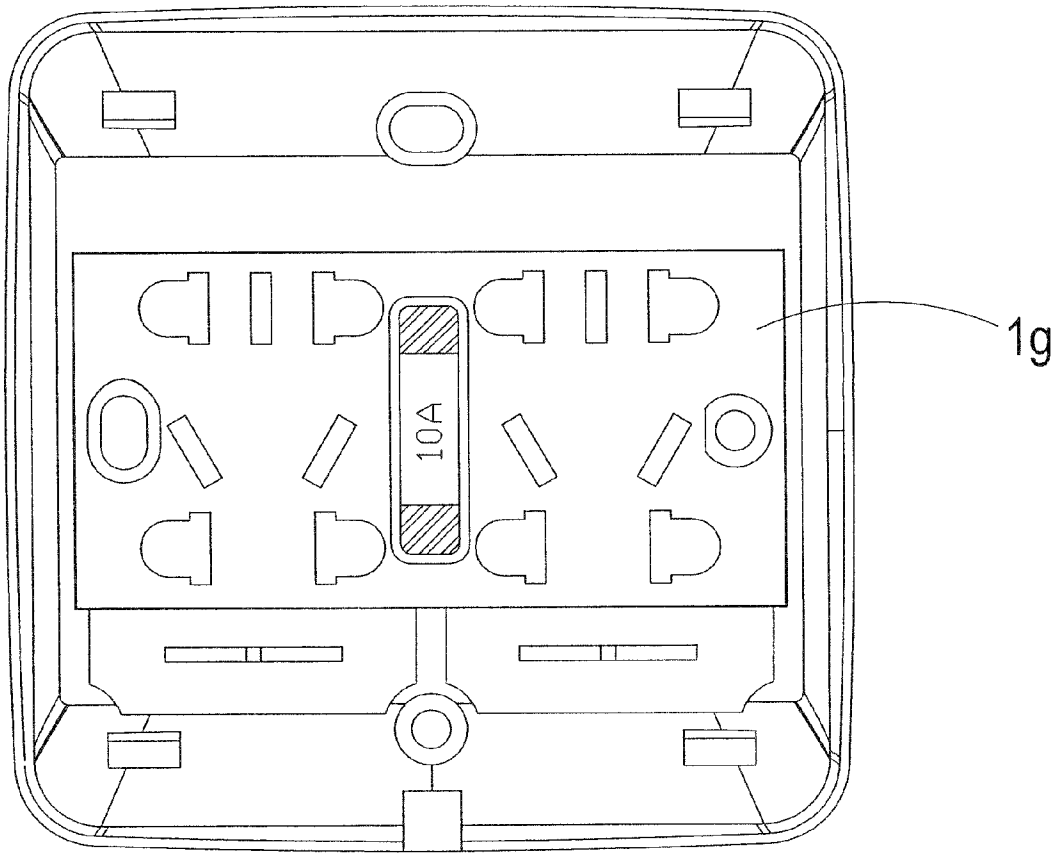
FIG. 29 is a schematic diagram showing a variation of the face plate according to an eighth embodiment of the present invention.

FIGS. 26, 26A, and 26B show a seventh embodiment of the universal plug adaptor. As illustrated, the face plate 1*f* contains a second hole set 20*f*, a third hold set 30*f*, and a fourth hole set 40*f* Please note that one of the plug holes of the fourth hole set 40*f* is T-shaped, and that the present embodiment allows the simultaneous plugging of two types of plugs. As shown in FIG. 26A, the face plate 1*f* contains the second hole sets 20*f* and the third hole sets 30*f*, and allows the simultaneous plugging of two Brazil plugs. As shown in FIG. 26B, the face plate 1*f* contains the second hole sets 20*f*, the third hole sets 30*f*, and the fourth hole sets 40*f* and allows the simultaneous plugging of one Brazil plug and one America plug.

Figure 30:
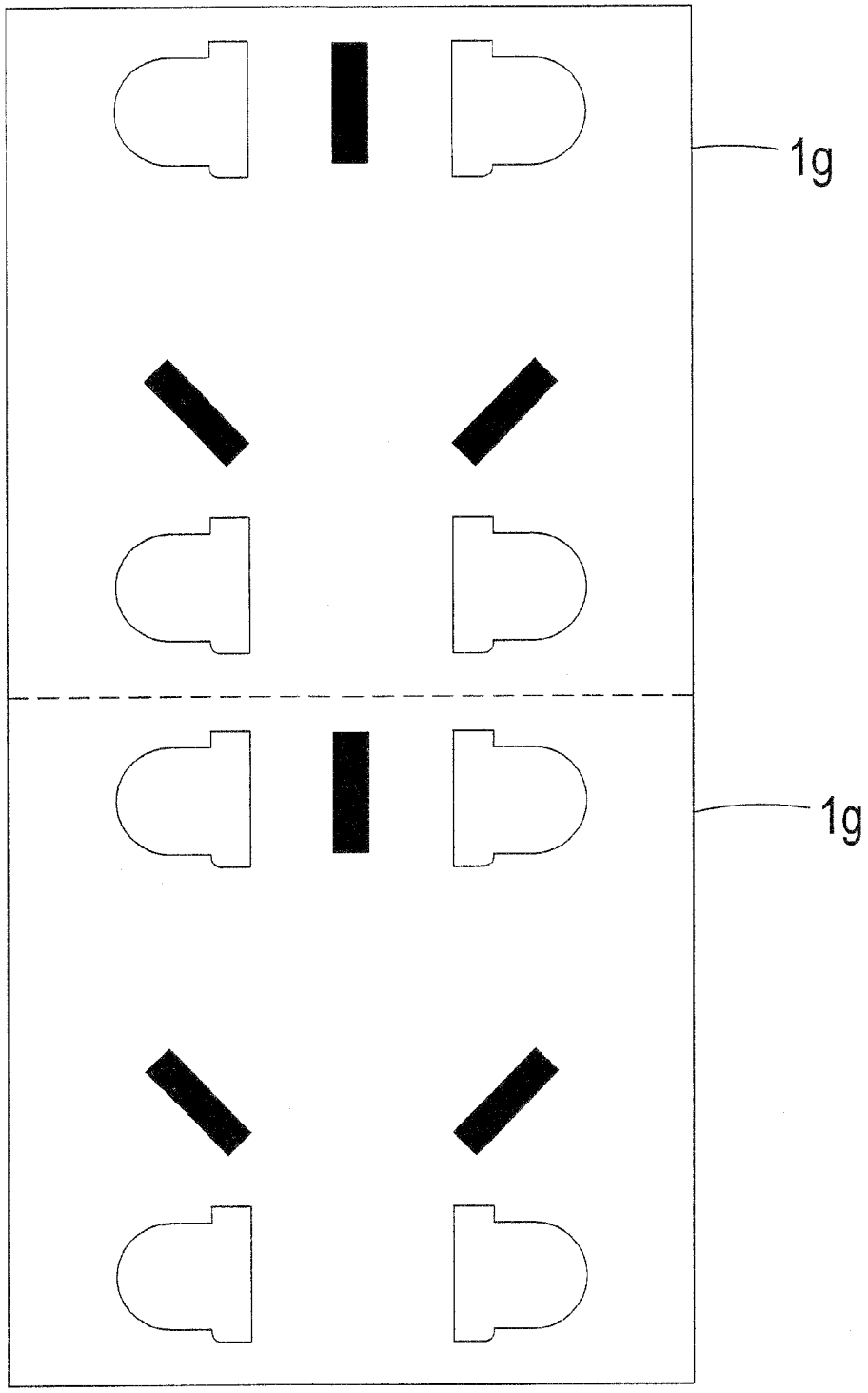
FIG. 30 is a schematic diagram showing a variation of the face plate according to an eighth embodiment of the present invention.
Figure 31:
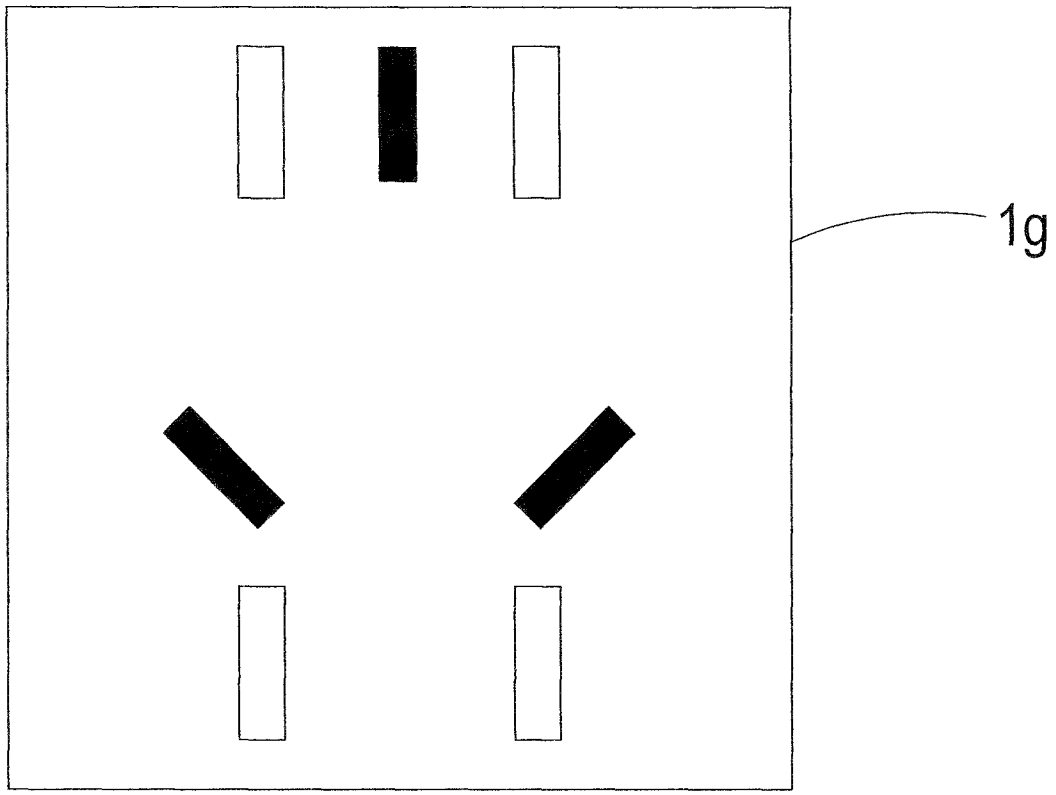
FIG. 31 is a schematic diagram showing a variation of the face plate according to an eighth embodiment of the present invention.
Figure 32:
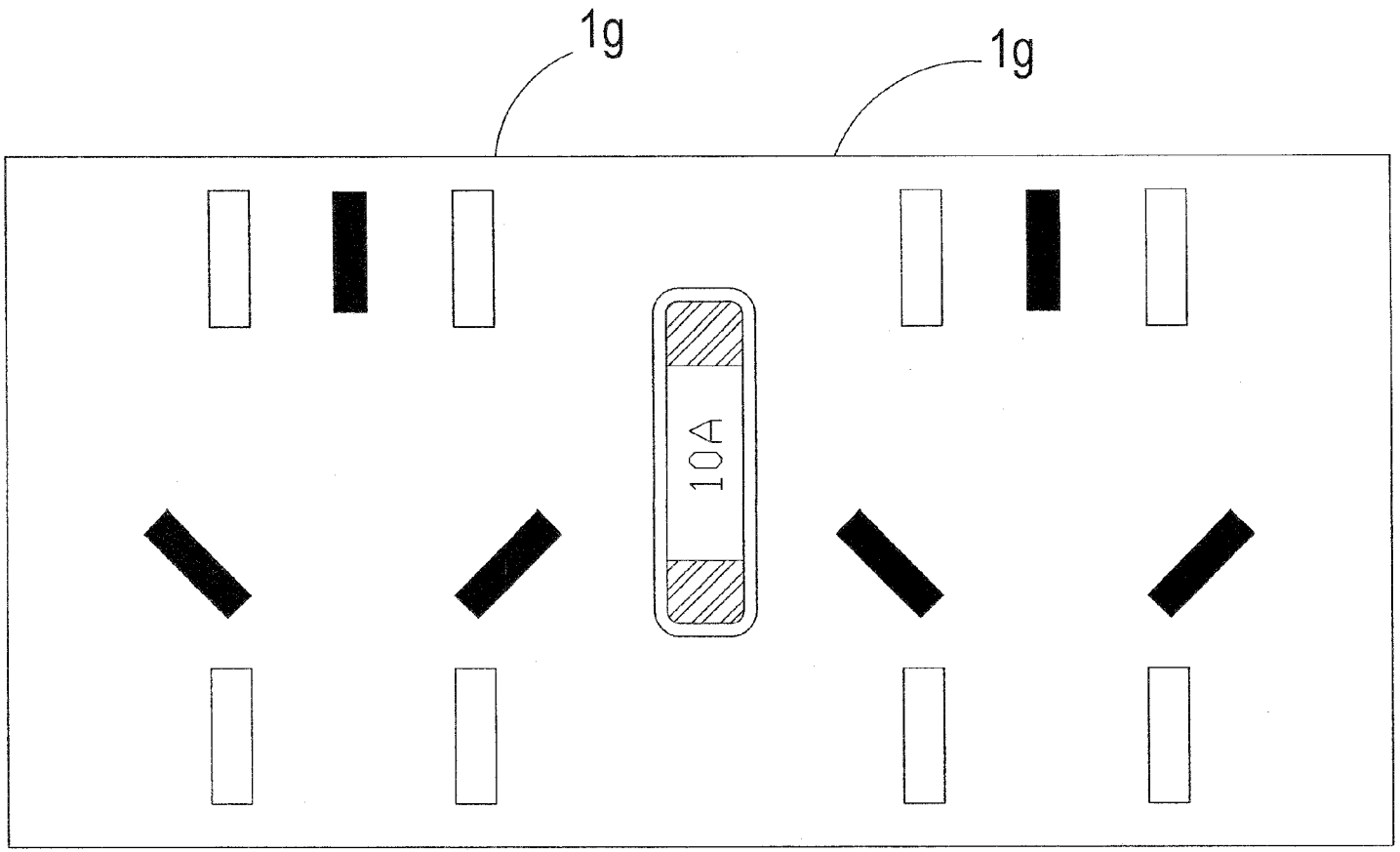
FIG. 32 is a schematic diagram showing a variation of the face plate according to an eighth embodiment of the present invention.
Figure 33:
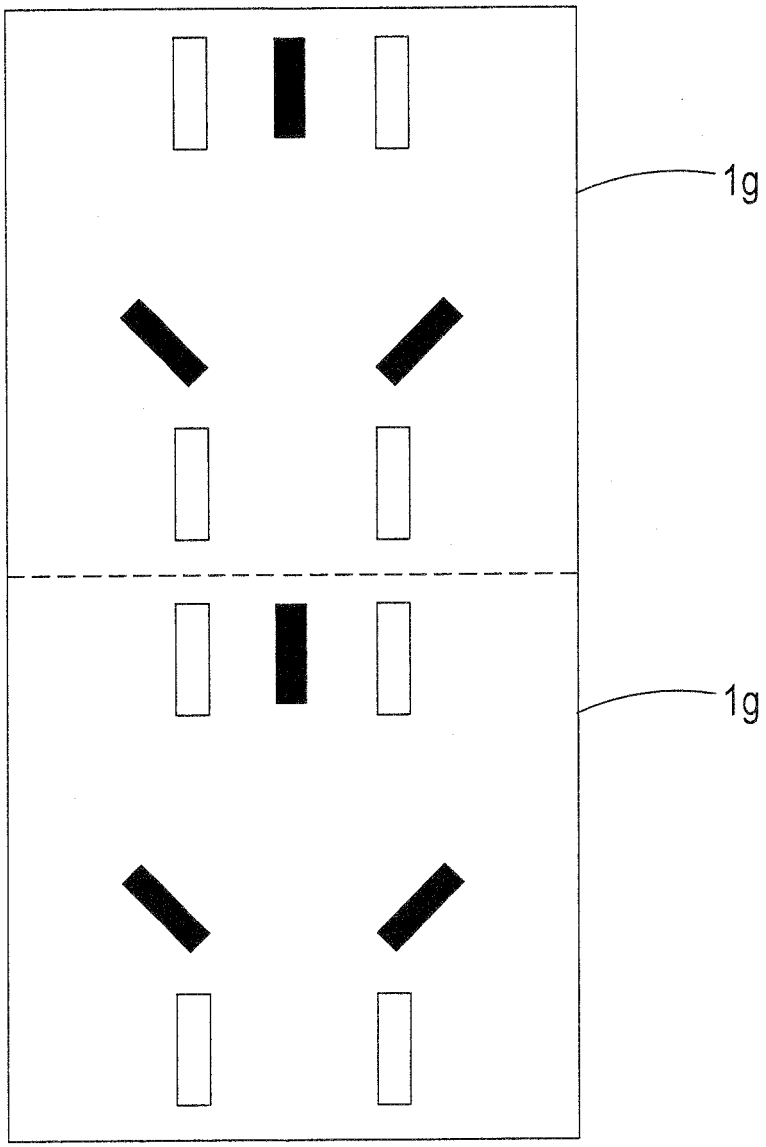
FIG. 33 is a schematic diagram showing a variation of the face plate according to an eighth embodiment of the present invention.
Figure 34:
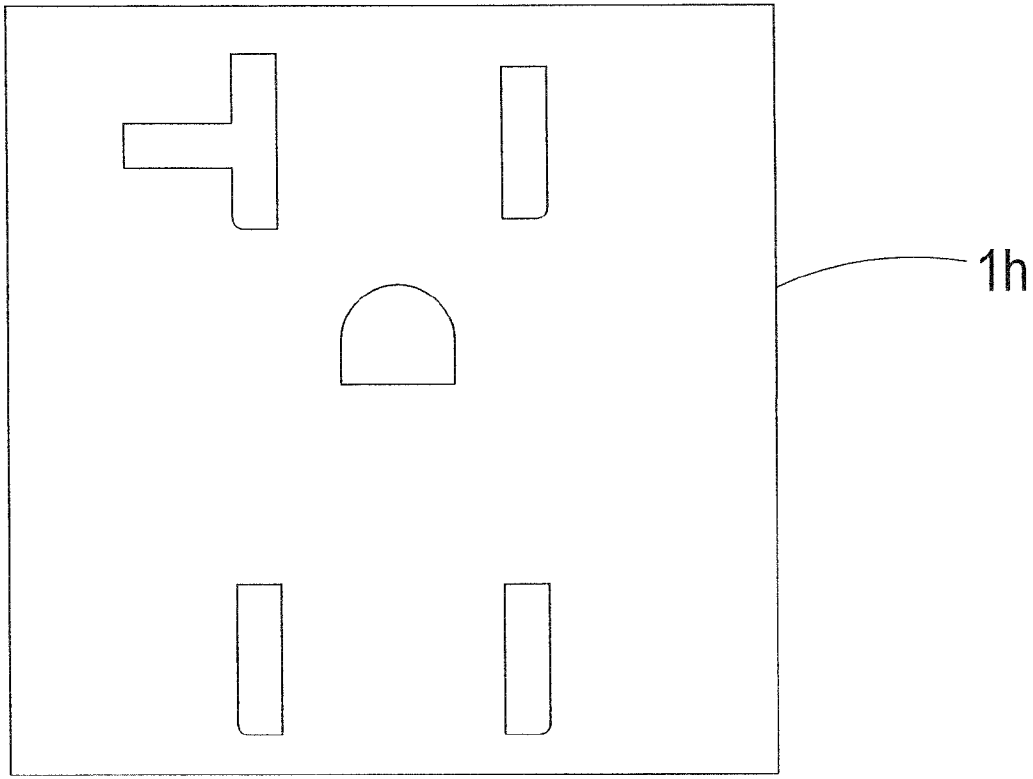
FIG. 34 is a schematic diagram showing a face plate according to a ninth embodiment of the present invention.
Figure 35:
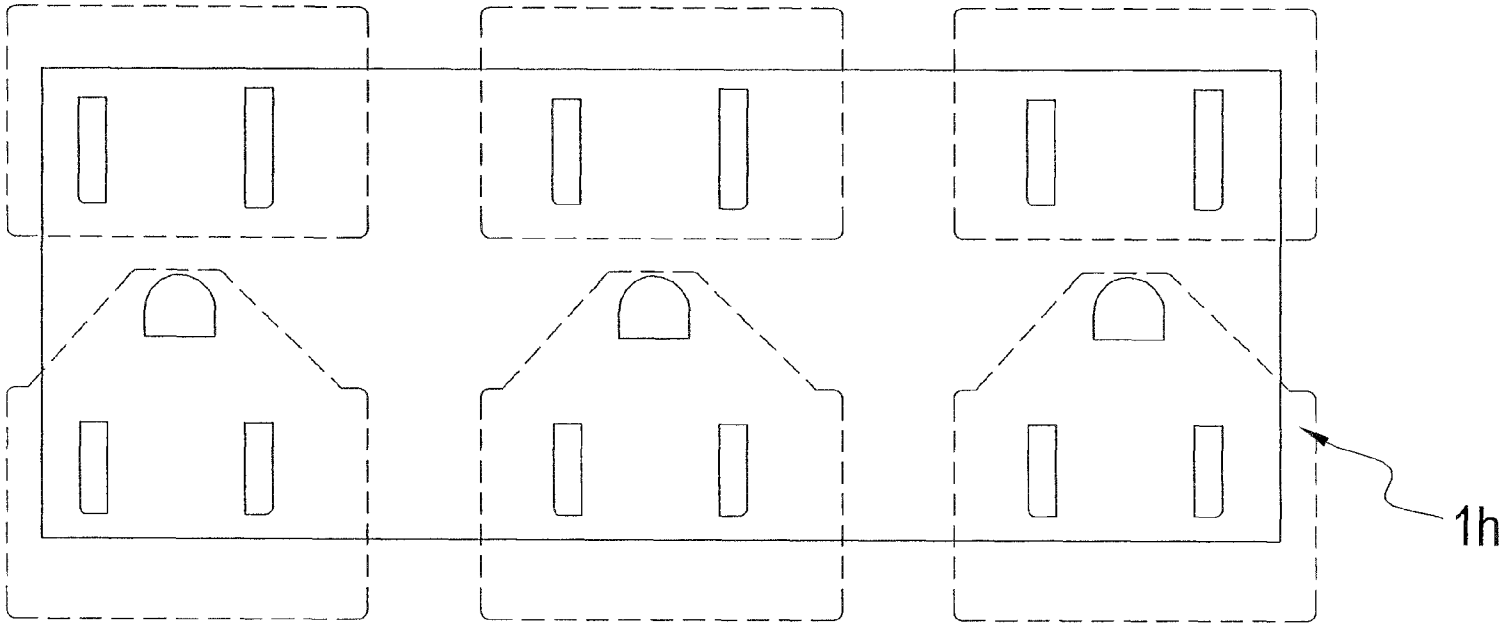
FIG. 35 is a schematic diagram showing a variation of the face plate according to a ninth embodiment of the present invention.

FIGS. 27 to 33 show an eighth embodiment of the universal plug adaptor. As illustrated, the face plate 1*g* is configured with plug holes for receiving China, Hong Kong, and Taiwan plugs, and allows the simultaneous plugging of one plug with two flat pins and one plug with two round pins. The face plate 1*g* could be utilized by itself (FIG. 27, FIG. 28, and FIG. 31, especially FIG. 28 where China plug and simultaneously plugging are supported), aligned laterally with another face plate 1*g* (FIG. 32), aligned laterally with another face plate 1*g* and with fuse configured (FIG. 29), or aligned vertically with another face plate 1*g* (FIG. 30, FIG. 33).

Figure 36:
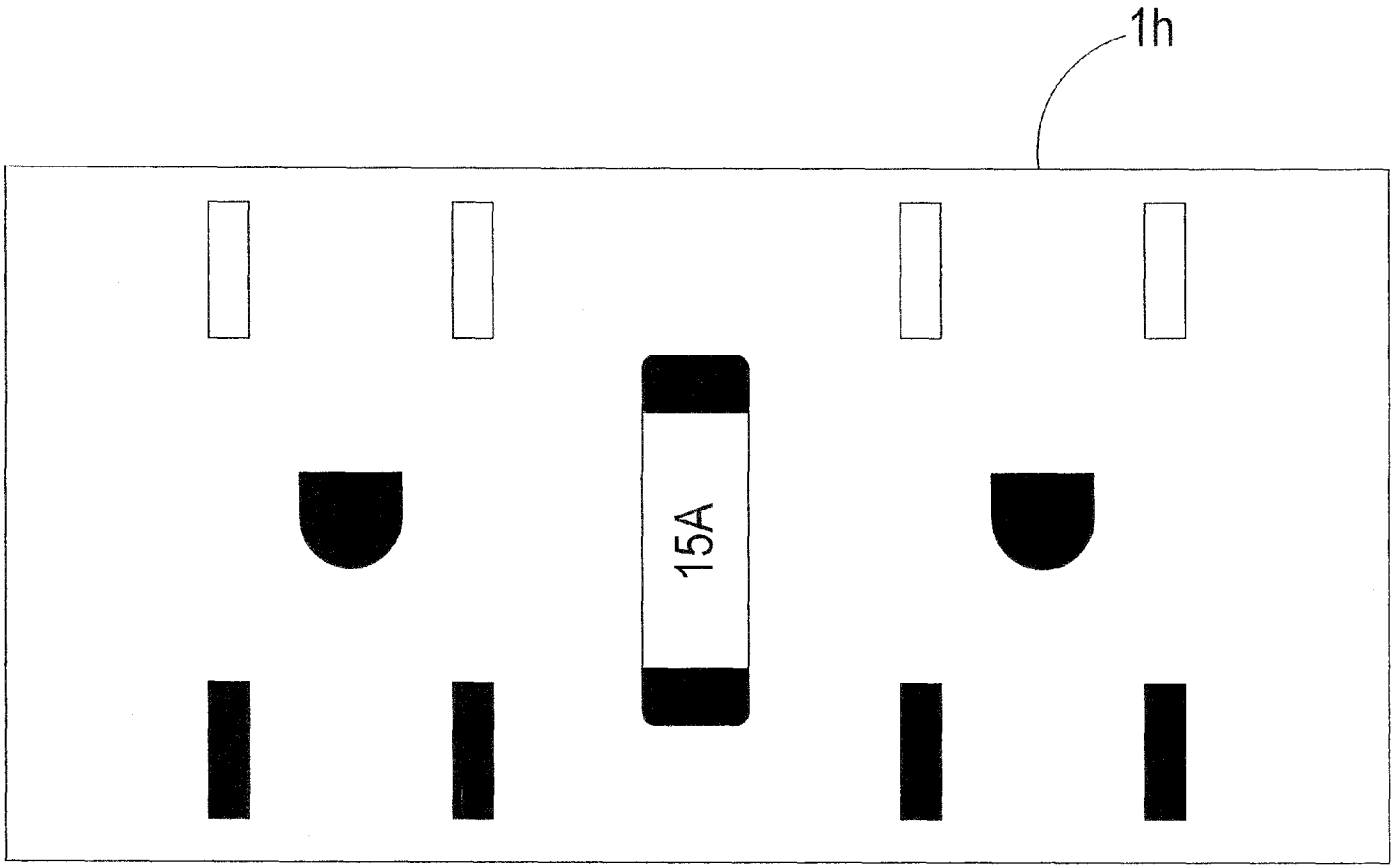
FIG. 36 is a schematic diagram showing a variation of the face plate according to a ninth embodiment of the present invention.
Figure 37:
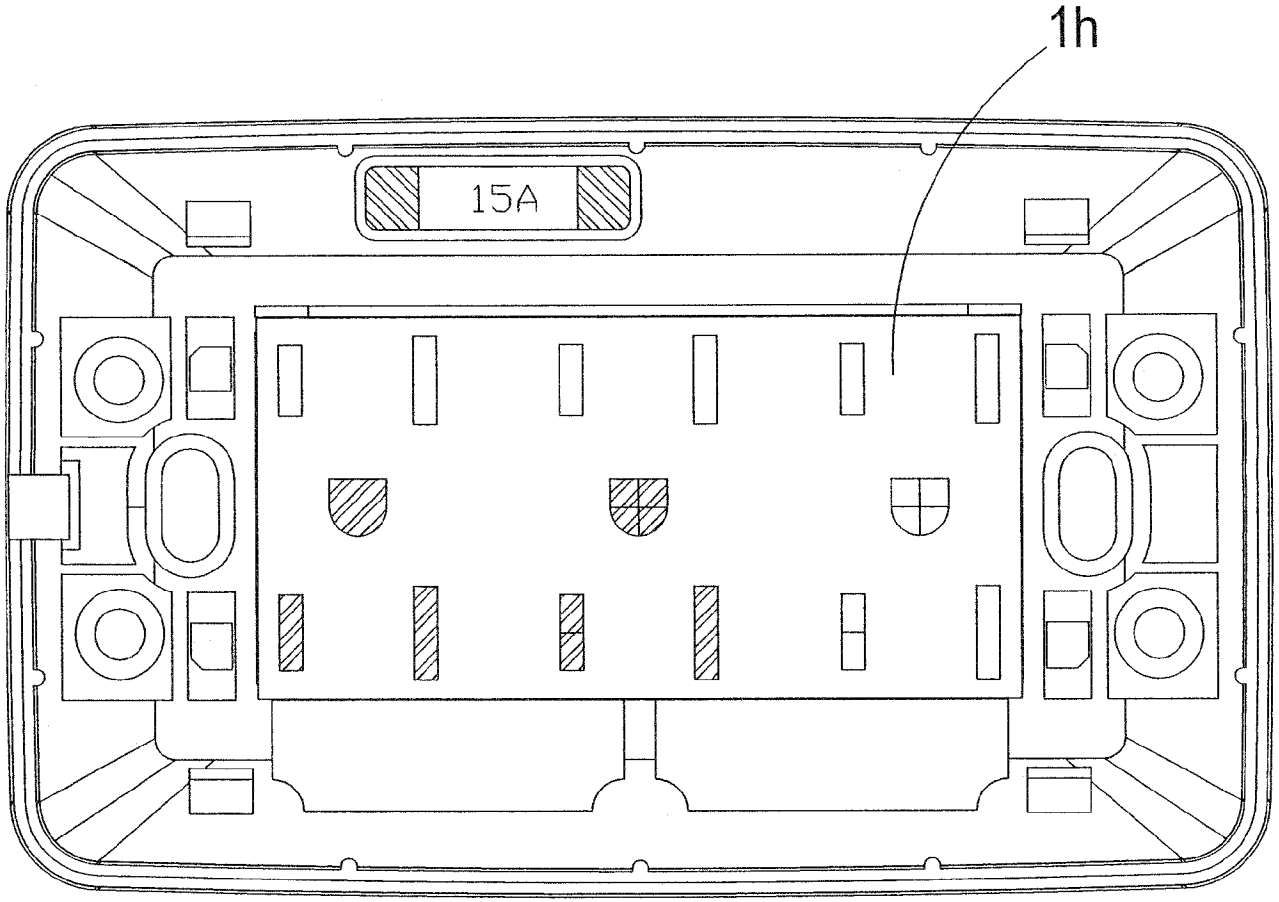
FIG. 37 is a schematic diagram showing a variation of the face plate according to a ninth embodiment of the present invention.
Figure 38:
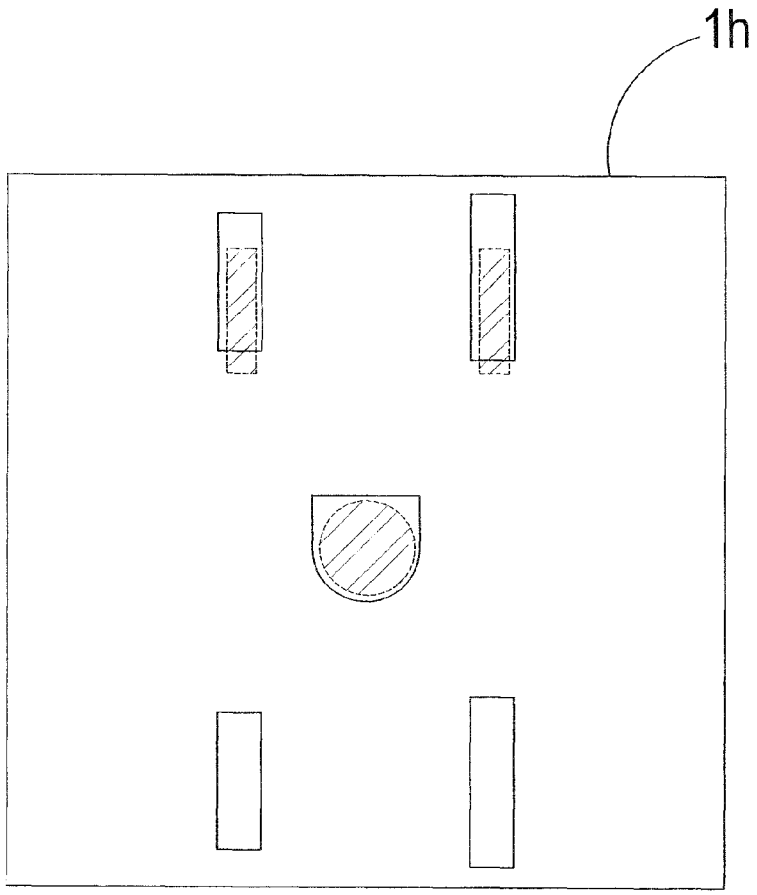
FIG. 38 is a schematic diagram showing a variation of the face plate according to a ninth embodiment of the present invention.
Figure 39:
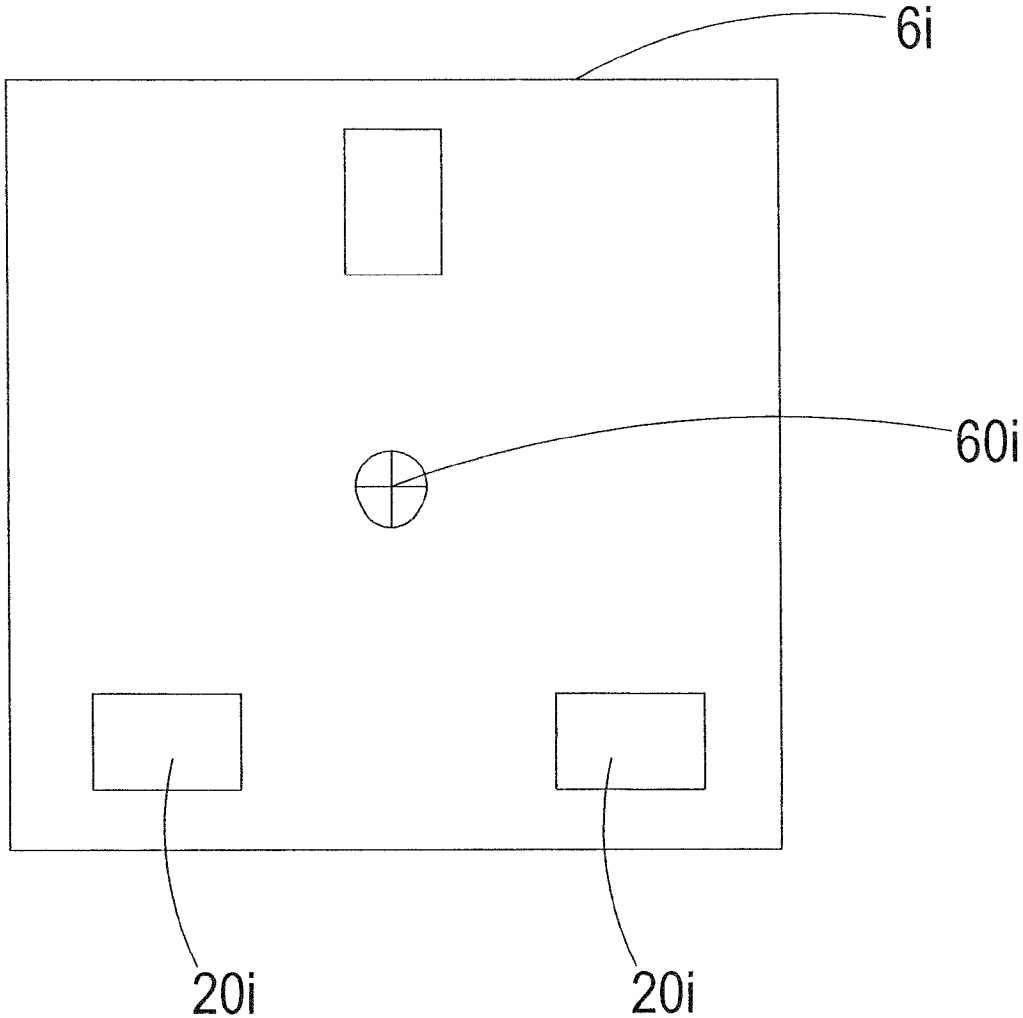
FIG. 39 is a schematic diagram showing a variation of the face plate according to a tenth embodiment of the present invention.
Figure 40:
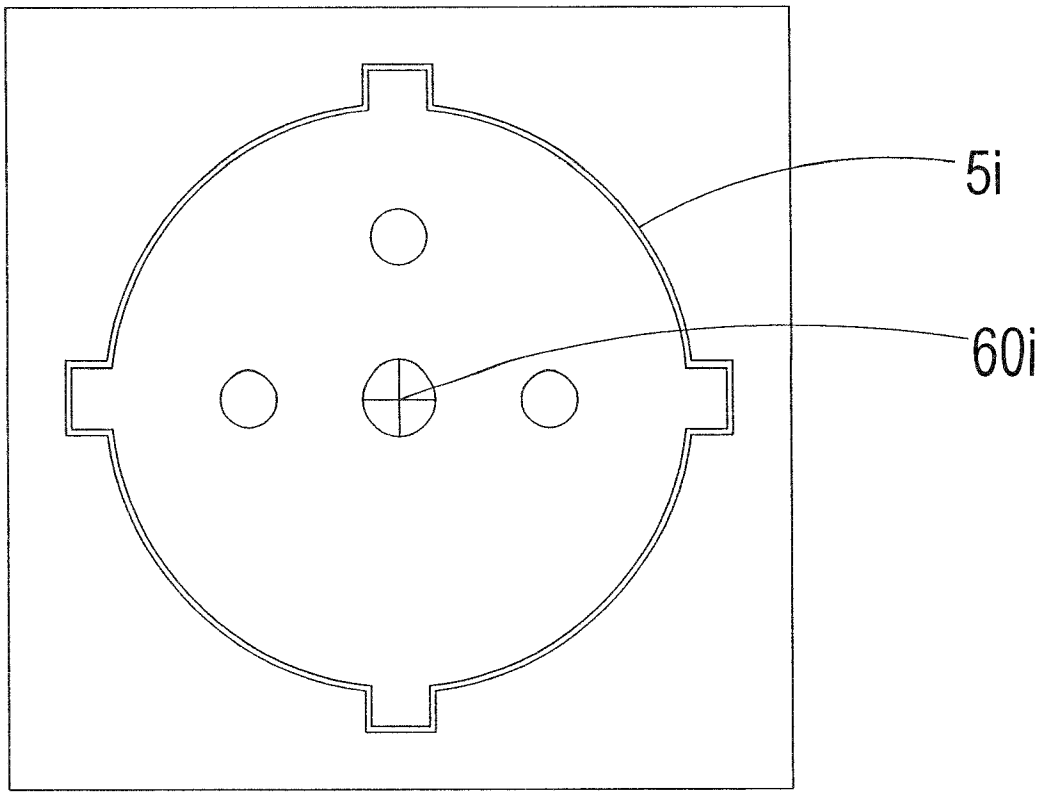
FIG. 40 is a schematic diagram showing a variation of the face plate according to a tenth embodiment of the present invention.
Figure 41:
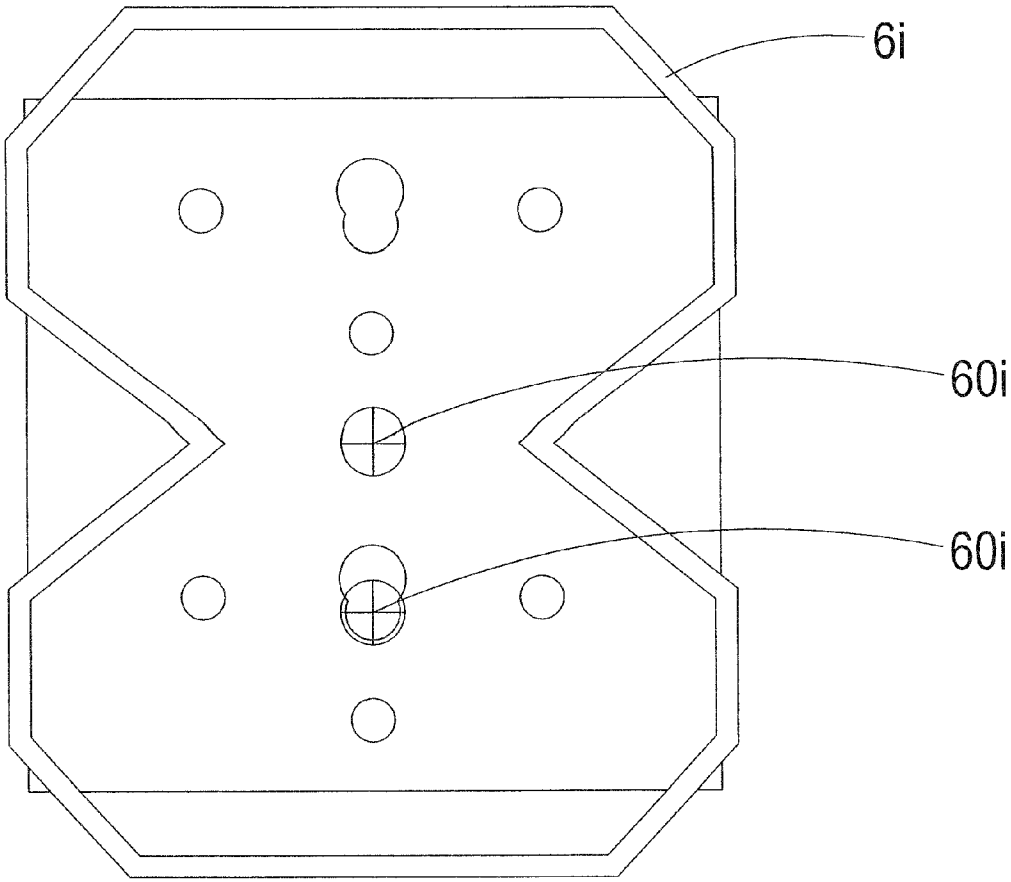
FIG. 41 is a schematic diagram showing a variation of the face plate according to a tenth embodiment of the present invention.
Figure 42:
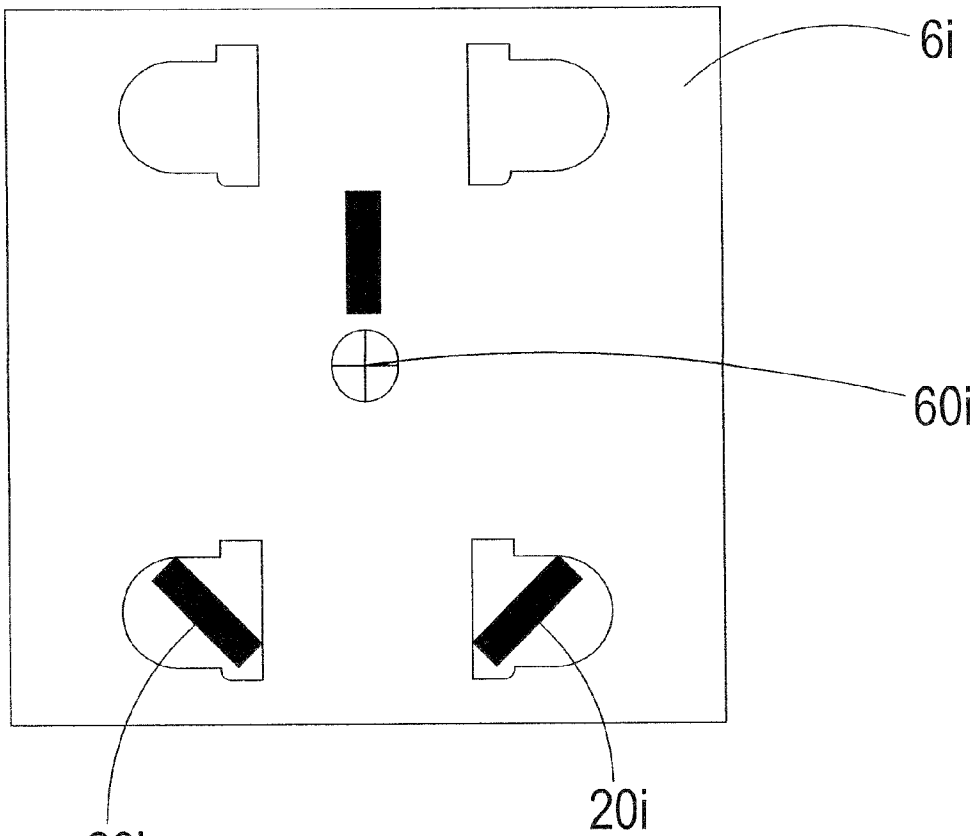
FIG. 42 is a schematic diagram showing a variation of the face plate according to a tenth embodiment of the present invention.
Figure 43:
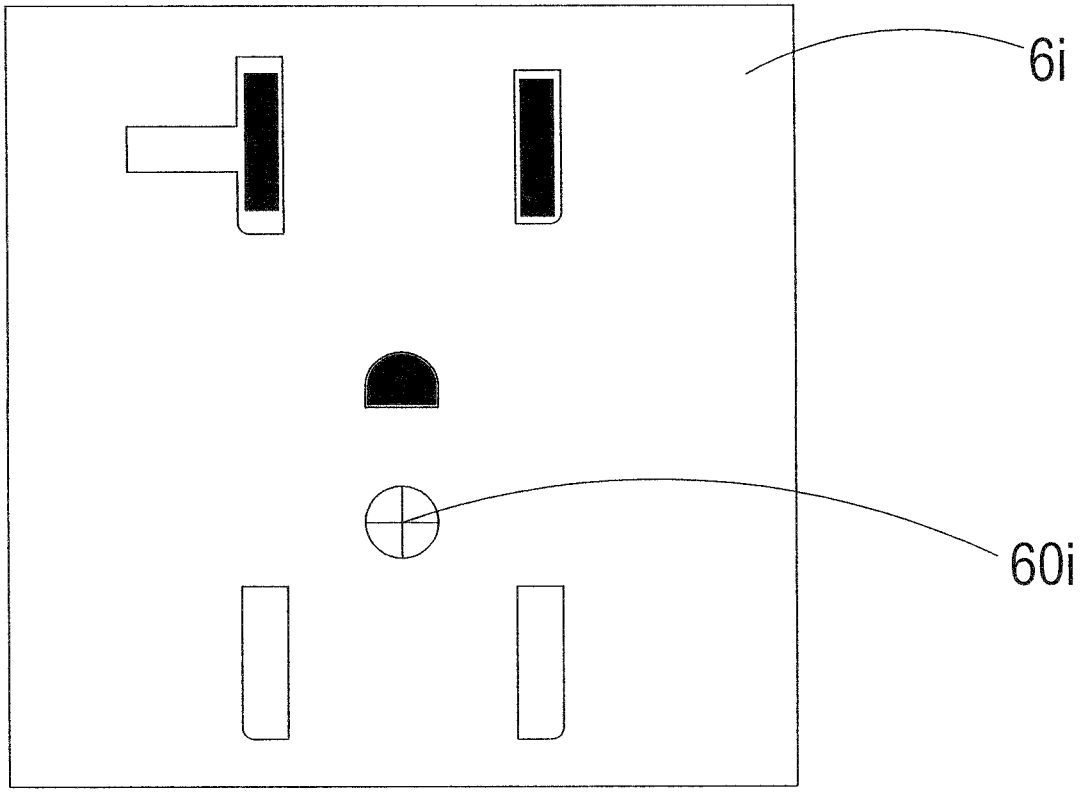
FIG. 43 is a schematic diagram showing a variation of the face plate according to a tenth embodiment of the present invention.
Figure 44:
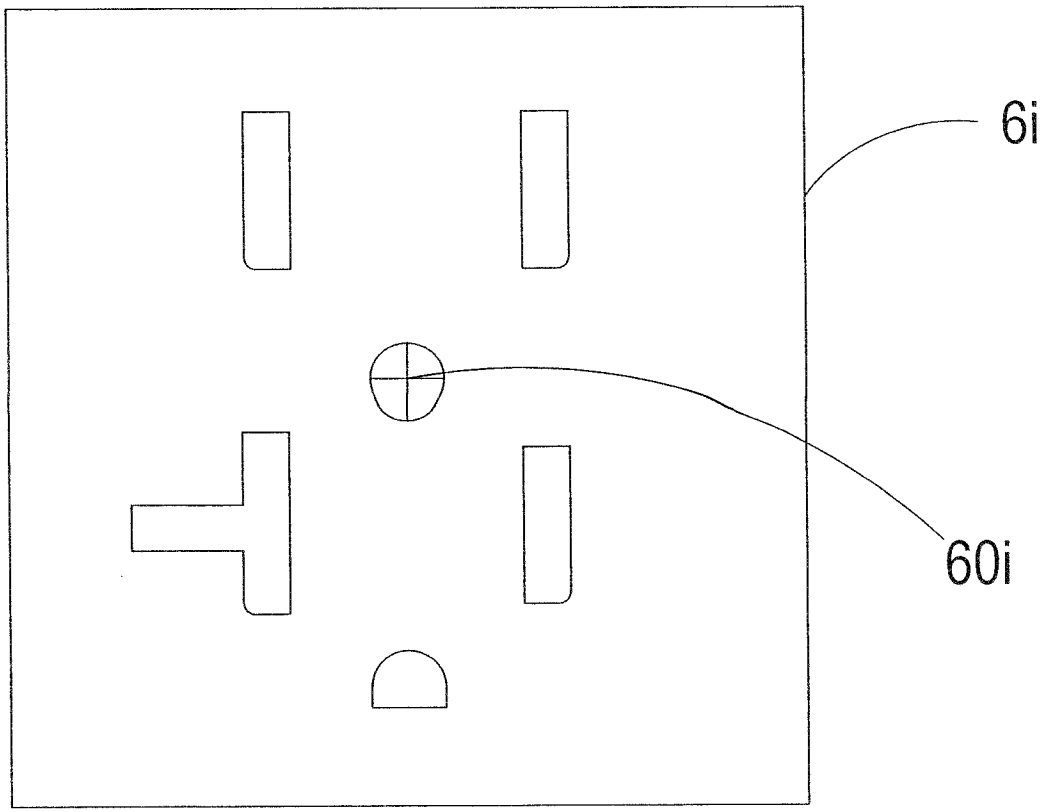
FIG. 44 is a schematic diagram showing a variation of the face plate according to a tenth embodiment of the present invention.

FIGS. 34 to 38 show a ninth embodiment of the universal plug adaptor. As illustrated, the face plate 1*h* is configured with plug holes for receiving America and Taiwan plugs, and allows the simultaneous plugging of two plugs. The face plate 1*h* could be utilized by itself supporting simultaneous plugging of two plugs (FIG. 34), on an extension cord (FIG. 25), aligned laterally with another face plate 1*g* (FIG. 32), aligned with another face plate 1*h* and with fuse configured (FIG. 36, FIG. 37). As shown in FIG. 38, when an America plug is reversed, it will not be received.

FIGS. 39 to 44 show a tenth embodiment of the universal plug adaptor. As illustrated, an additional cover plate 5*i* or 6*i* can be fastened to the face plate by at least a bolt 60*i*. The cover plate 6*i* supports Britain, Swiss, Brazil, Italy, China plugs whose live pins and neutral pins are received by the second hole set 20*i* or corresponding plug holes. Alternatively, the cover plate 5*i* conforms to Germany and French plug specifications and corresponds to the second hole set. Additionally, the rim of the cover plate 5*i* is configured with a ground connection element.

Figure 45:
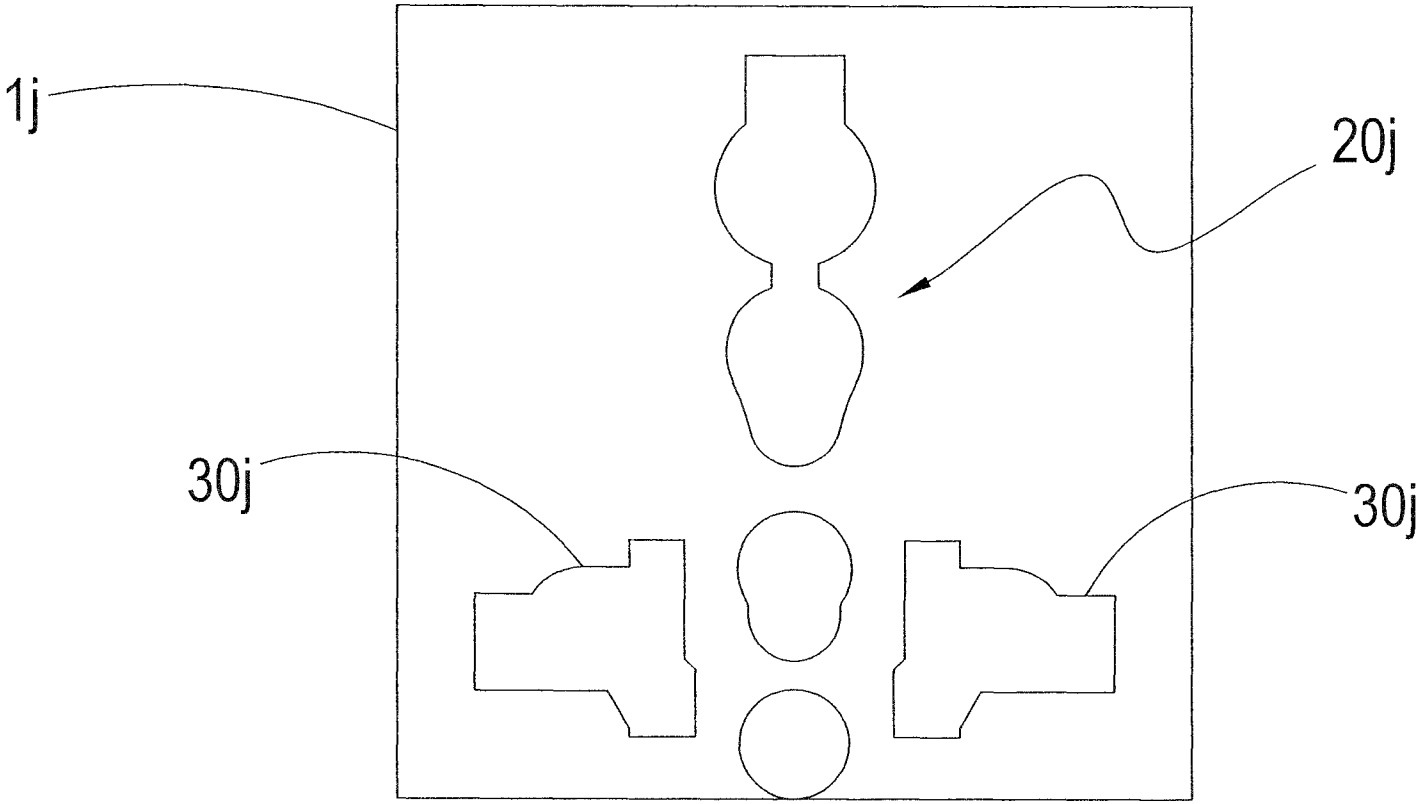
FIG. 45 is a schematic diagram showing a face plate according to an eleventh embodiment of the present invention.

As shown in FIG. 45, the face plate 1*j* of an eleventh embodiment contains a second hole set 20*j* and a third hole set 30*j*.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A universal plug adaptor, comprising:

a face plate having plural sets of plug holes aligned and distributed symmetrically along a middle line of said face plate;

a casing joined to said face plate with a terminal set inside for contacting plug pins; and a safety-door device conforming to the South Africa specification configured between said face plate and said casing 2;

wherein a first hole set of said face plate comprises a first live hole, a first neutral hole, and a first ground hole conforming to the South Africa specification;

wherein a second hole set of said face plate comprises three separate openings sequentially arranged along the middle line, each being a combination of ground holes conforming to ground pins of various specifications connected sequentially together; a first opening contains a second ground hole conforming to the Britain specification, a third ground hole adjacent to said second ground hole conforming to the India specification, a fourth ground hole adjacent to said third ground hole conforming to the China and Australia 10 A and 16 A specifications, a fifth ground hole adjacent to said fourth ground hole conforming to the Denmark specifications, a sixth ground hole adjacent to said fifth ground hole conforming to the Philippine 10 A specification of America 250V, a seventh ground hole coinciding with said sixth ground hole conforming to the America 15 A specification, an eighth ground hole coinciding with said sixth and seventh ground holes conforming to the America 20 A specification, a ninth ground hole adjacent to said sixth, seventh, and eighth ground holes and conforming to the Middle East specification, and a tenth ground hole adjacent to said ninth ground hole and conforming to the Israel specification; a second opening contains an eleventh ground hole conforming to the Brazil specification and a twelfth ground hole adjacent to said eleventh ground hole and conforming to the Italy specification; and a third opening contains a thirteenth ground hole conforming to Swiss specification, and a fourteenth ground hole and a fifth ground hole, conforming to two types of America 125V specifications;

wherein a third hole set of said face plate comprises two symmetric plug holes conforming to global 250V specification with two flat pins or two round pins;

wherein a fourth hole set comprises two symmetric plug holes conforming to America 125V specification with two flat pints or two round pins;

wherein a fifth hole set comprises two plug holes conforming to America specification with two flat pins;

wherein said third and fourth hole sets jointly provide two plugs' simultaneous plugging with their ground pins jointly received by said second hole set.

2. The universal plug adaptor according to claim 1, wherein said terminal set is capable of receiving, through said second, third, fourth, and fifth hole sets, plugs conforming to Brazil, Italy, Swiss, two type of America 125V plugs with two flat pins, America 125V specification with two flat pints or two round pins.

3. The universal plug adaptor according to claim 1, wherein said face plate is fastened with at least a cover plate having a plurality of plug holes.

4. The universal plug adaptor according to claim 1, wherein said first hole set, said third hole set, and said fourth hole set, together with said second hole set, are capable of receiving plugs conforming to the South Africa, Britain, India, China and Australia 10 A and 16 A, Denmark, Philippine of America 250V, America 15 A and 20 A, Middle East, Israel, Brazil, Italy, Swiss, two type of America 125V with two flat pins, America 125V with two flat pints or two round pins specifications; and allow for the simultaneous plugging of two plugs with their ground pins jointly received by said second hole set.

5. The universal plug adaptor according to claim 1, wherein said first hole set, said third hole set, and said fifth hole set, together with said second hole set, are capable of receiving plugs conforming to the South Africa, Britain, India, China and Australia 10 A and 16 A, Denmark, Philippine of America 250V, America 15 A and 20 A, Middle East, Israel, Brazil, Italy, Swiss, two type of America 125V with two flat pins, America 125V with two flat pints or two round pins specifications.

6. The universal plug adaptor according to claim 1, wherein said third hole set, and said fourth or fifth hole set, together with said second hole set, are capable of receiving plugs conforming to the Britain, India, China and Australia 10 A and 16 A, Denmark, Philippine of America 250V, America 15 A and 20 A, Middle East, Israel, Brazil, Italy, Swiss, two type of America 125V with two flat pins, America 125V with two flat pints or two round pins specifications; and allow for the simultaneous plugging of two plugs with their ground pins jointly received by said second hole set.

7. The universal plug adaptor according to claim 1, wherein said third hole set, together with said second hole set, are capable of receiving plugs conforming to Britain, India, China and Australia 10 A and 16 A, Denmark, Philippine of America 250V, America 15 A and 20 A, Middle East, Israel, Brazil, Italy, Swiss, and two type of America 125V with two flat pins.

8. The universal plug adaptor according to claim 1, further comprising a second face plate; and said second face plate comprises a combination of said first, second, third, fourth, and fifth hole sets.

9. The universal plug adaptor according to claim 1, wherein said face plate is fastened with at least a cover plate having a plurality of plug holes conforming to Germany and French plug specifications; the rim of said cover plate is configured with a ground connection element; and said cover plate corresponds to said second hole set.

* * * * *